US012674372B2

(12) United States Patent
Trifol et al.

(10) Patent No.: US 12,674,372 B2
(45) Date of Patent: Jul. 7, 2026

(54) AUTONOMOUS VALVE SYSTEM

(71) Applicant: Schlumberger Technology Corporation, Sugar Land, TX (US)

(72) Inventors: Hugues Trifol, Clamart (FR); Damien Chazal, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 396 days.

(21) Appl. No.: 18/262,195

(22) PCT Filed: Jan. 20, 2022

(86) PCT No.: PCT/US2022/013107

§ 371 (c)(1),
(2) Date: Jul. 20, 2023

(87) PCT Pub. No.: WO2022/159567

PCT Pub. Date: Jul. 28, 2022

(65) Prior Publication Data

US 2024/0076953 A1 Mar. 7, 2024

Related U.S. Application Data

(60) Provisional application No. 63/139,881, filed on Jan. 21, 2021.

(51) Int. Cl.
*E21B 34/02* (2006.01)
*E21B 47/06* (2012.01)

(52) U.S. Cl.
CPC ..... *E21B 34/025* (2020.05); *E21B 47/06* (2013.01)

(58) Field of Classification Search
CPC ..... E21B 34/025; E21B 47/06; E21B 43/12; E21B 21/08
See application file for complete search history.

(56) References Cited

U.S. PATENT DOCUMENTS

2004/0144565 A1 7/2004 Koederitz
2012/0255776 A1* 10/2012 Knudsen ..... E21B 21/08 175/25

(Continued)

FOREIGN PATENT DOCUMENTS

WO 2018165352 A1 9/2018
WO 2020140000 A1 7/2020

OTHER PUBLICATIONS

Nandan, Anirudh. "Advanced control of managed pressure drilling." Doctoral dissertation, Memorial University of Newfoundland, 2016. pp. 39-41. (Year: 2016).*

(Continued)

*Primary Examiner* — Robert E Fennema
*Assistant Examiner* — Magdalena I Kossek
(74) *Attorney, Agent, or Firm* — Jeffrey D. Frantz

(57) ABSTRACT

A control system can include a controller that includes an interface for receipt of sensor data generated by sensors operatively coupled to a fluid flow system; memory that includes sets of tuning parameter values; and a loader that loads a selected set of the sets of tuning parameter values into the controller for issuance of control signals to a choke valve actuator for a choke valve of the fluid flow system according to the selected set of tuning parameter values and sensor data generated by one or more of the sensors.

17 Claims, 21 Drawing Sheets

(56) References Cited

U.S. PATENT DOCUMENTS

| | | | | |
|---|---|---|---|---|
| 2015/0368999 | A1* | 12/2015 | Massa de Campos | E21B 34/025 700/282 |
| 2016/0102511 | A1* | 4/2016 | Brana | E21B 21/08 700/282 |
| 2016/0298401 | A1* | 10/2016 | Cotten | E21B 21/106 |
| 2017/0226813 | A1* | 8/2017 | Northam | E21B 47/06 |
| 2017/0328151 | A1 | 11/2017 | Dillard et al. | |
| 2018/0010429 | A1 | 1/2018 | Willberg et al. | |
| 2018/0135365 | A1* | 5/2018 | Knudsen | E21B 44/00 |
| 2018/0328127 | A1 | 11/2018 | Ravi et al. | |
| 2021/0002995 | A1* | 1/2021 | Botnan | E21B 47/06 |

OTHER PUBLICATIONS

Search Report and Written Opinion of International Patent Application No. PCT/US2022/013107 dated on May 3, 2022, 15 pages.

* cited by examiner

1210

1230

| Process variable | Low regulation band | High regulation band | Safe working zone |
|---|---|---|---|
| PT 01 | SP +/- 2.5% | SP +/- 10% | [500 - 10000] psi |
| PT 02 | N/A | N/A | [100 - 2500] psi |
| PT 03 | SP +/- 2.5% | SP +/- 10% | [500 - 5000] psi |
| FT 01 | SP +/- 2.5% | SP +/- 10% | N/A |

AUTONOMOUS VALVE SYSTEM

RELATED APPLICATION

This application is a National Stage Entry of International Application No. PCT/US2022/013107 filed Jan. 20, 2022, which claims priority to and the benefit of a U.S. Provisional Application having Ser. No. 63/139,881 filed 21 Jan. 2021, which is incorporated by reference herein.

BACKGROUND

Field

Embodiments described herein generally relate to systems for hydrocarbon reservoirs. Specifically, embodiments described herein relate to control of such systems.

Description of the Related Art

The global oil and gas industry is trending toward improved environmental safety and compliance throughout the various phases of a well lifecycle. Various phases include use of equipment, which can include equipment that is manually operated by one or more members of a crew where the placement of the equipment and/or the operation of the equipment may present risks.

SUMMARY

Embodiments described herein provide a control system that can include a controller that includes an interface for receipt of sensor data generated by sensors operatively coupled to a fluid flow system; memory that includes sets of tuning parameter values; and a loader that loads a selected set of the sets of tuning parameter values into the controller for issuance of control signals to a choke valve actuator for a choke valve of the fluid flow system according to the selected set of tuning parameter values and sensor data generated by one or more of the sensors. Various other examples of methods, systems, computer-program products, etc., are also described herein.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
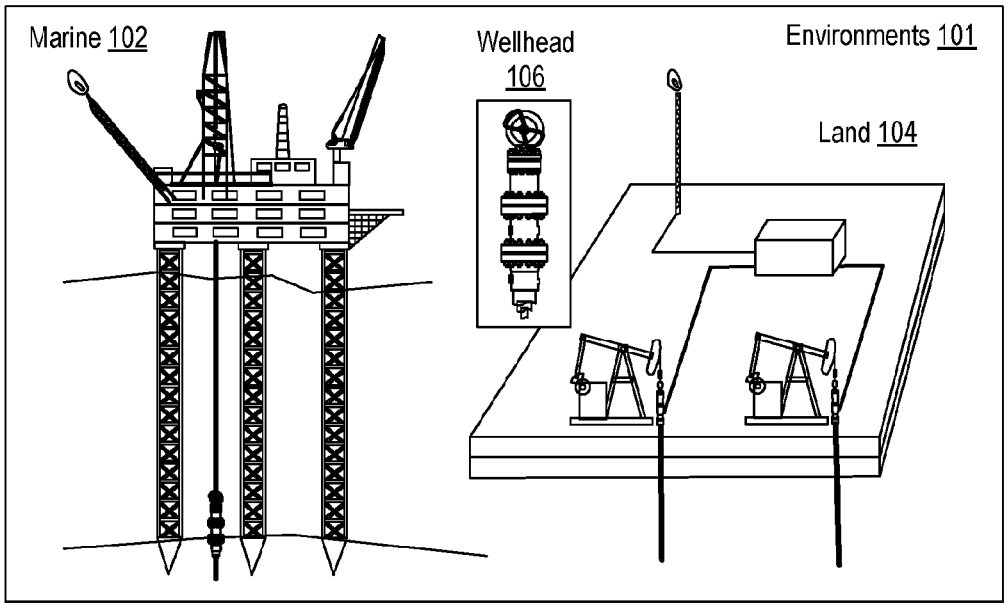
FIG. 1 is a series of diagrams of example environments and an example of a surface system.
Figure 1:
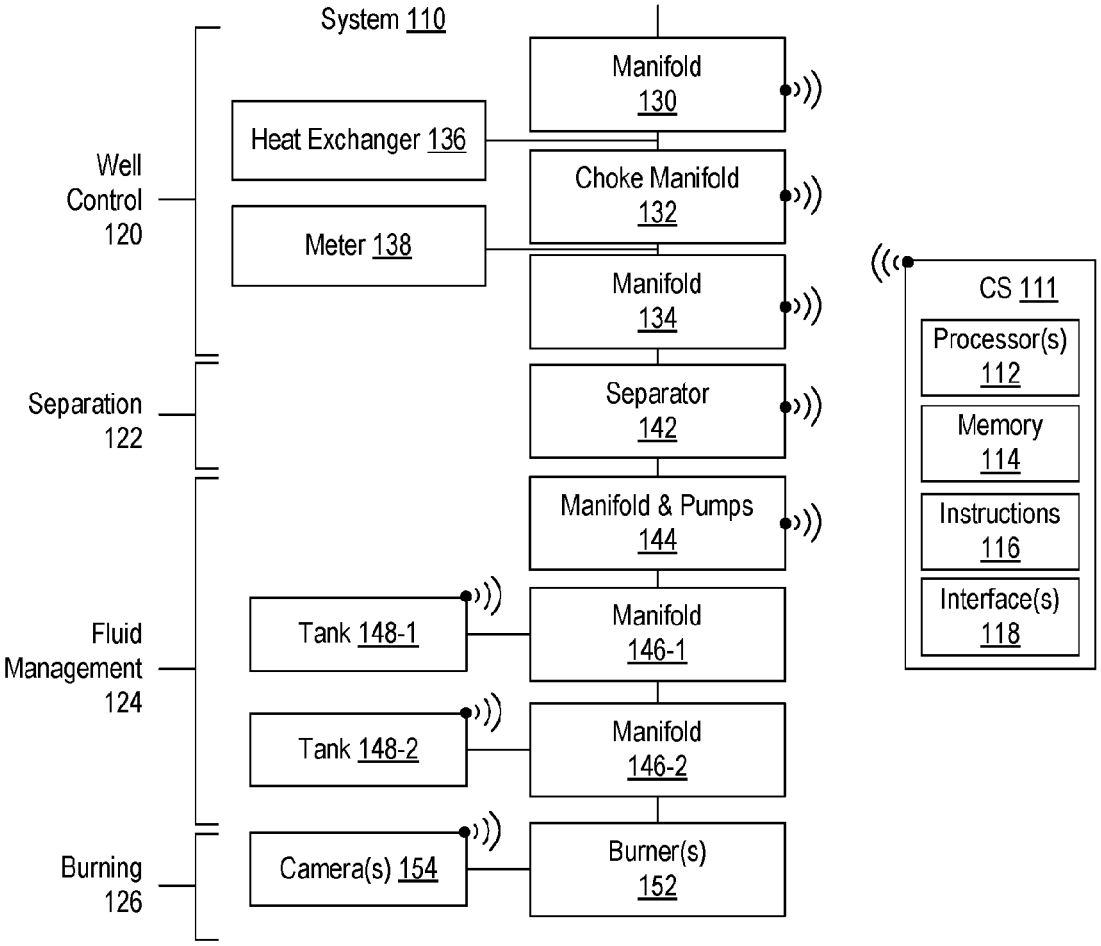

FIG. 1 shows examples of environments 101, including a marine environment 102 and a land environment 104 where the marine environment 102 includes various equipment and where the land environment 104 includes various equipment. As shown, each of the environments 101 can include one or more wellheads 106 (e.g., wellhead equipment). A wellhead can be a surface termination of a wellbore that can include a system of spools, valves and assorted adapters that, for example, can provide for pressure control of a production well. A wellhead may be at a land surface, a subsea surface (e.g., an ocean bottom, etc.), etc. As an example, a wellhead can include one or more valves such as, for example, one or more choke valves. A choke valve may be located on or near a Christmas tree that is used to control the production of fluid from a well. For example, opening or closing a variable valve can influence the rate and pressure at which production fluids progress through a pipeline, process facilities, etc. As an example, an adjustable choke may be operatively coupled to an automated control system to enable one or more production parameters of one or more individual wells to be controlled. As an example, conduits from multiple wellheads may be joined at one or more manifolds such that fluid from multiple wells can be flow in a common conduit.

As shown, in various environments, during one or more phases of development, production, etc., surface equipment can be present that is in fluid communication with a borehole, a completed well, etc. Such surface equipment (e.g., a surface system) can be in fluid communication for purposes of fluid injection and/or fluid production. For example, fluid injection can include injection of hydraulic fracturing fluid to generate fractures in a reservoir to increase production of hydrocarbon containing fluids from the reservoir, injection of treatment fluid such as a fluid for stimulation purposes, etc. As to fluid production, surface equipment can include various types of conduits, valves, meters, separators, etc. As an example, a surface system can include equipment that can be standalone in its operation and/or control. For example, a sub-system may be skid-mounted with a controller unit provided. In such an example, an overarching controller system may be operatively coupled to the controller unit. Where a surface system includes various sub-systems, each may include its own controller unit and/or interface that can be operatively coupled to an overarching controller system.

In various instances, however, an overarching controller system approach can make supervisory control decisions that may impact a sub-system where the sub-system may be left on its own as to how it handles or responds to a supervisory control decision. For example, consider an approach that aims to adequately control one or more set points (e.g., pressure, level, etc.) and that may take higher level actions as appropriate such as regulating flowrate to remain in a pressure/flowrate range of equipment.

In various examples, an autonomous surface system is described with respect to surface equipment associated with well testing, noting that, as mentioned, one or more other types of surface system may be similarly instrumented to be an autonomous surface system for one or more purposes.

Referring again to FIG. 1, at various times, a well may be tested using a process referred to as well testing. Well testing can include one or more of a variety of well testing operations. In various instances, fluid can flow from a well or wells to surface where the fluid is subjected to one or more well testing operations and generates scrap (e.g., waste fluid), which is to be handled appropriately, for example, according to circumstances, regulations, etc. For example, consider loading waste fluid into a tanker for transport to a facility that can dispose of the waste fluid. Another manner of handling waste fluid can be through combustion, which can be referred to as burning. As an example, burning can be part of a well testing process, whether burning is for handling waste fluid and/or for analyzing one or more aspects of how one or more waste fluids burn. As to the latter, burning may optionally provide data as to one or more characteristics of well fluid (e.g., a component thereof, etc.).

As an example, well testing can be performed during one or more phases such as during exploration and appraisal where production of hydrocarbons are tested using a temporary production facility that can provide for fluid sampling, flow rate analysis and pressure information generation, for example, to help characterize a reservoir. Various decisions can be based on well testing such as, for example, decisions as to production methods, facilities and possible well productivity improvements.

As to the example environments 101 of FIG. 1, well testing may be performed, for example, using equipment shown in the marine environment 102 and/or using equipment shown in the land environment 104. As an example, an environment may be under exploration, development, appraisal, etc., where such an environment includes at least one well where well fluid can be produced (e.g., via natural pressure, via fracturing, via artificial lift, via pumping, via flooding, etc.). In such an environment, various types of equipment may be on-site, which may be operatively coupled to well testing equipment.

As to artificial lift, consider utilization of one or more technologies such as, for example, gas lift, electric submersible pump (ESP) lift, etc. In a gas lift scenario, one or more valves may be controlled as to gas that can be injected into a reservoir fluid that can assist with producing the reservoir fluid at a wellhead. In such an example, one or more pocket valves, packer valves, surface valves, etc., may be utilized. As to ESP lift, consider a downhole ESP system that can pump reservoir fluid in a direction of a wellhead. As an example, a controller may be utilized for controlling one or more aspects of an artificial lift operation or operations at one or more wells.

FIG. 1 shows an example of a system 110 (e.g., a surface system) that can be operatively coupled to one or more conduits that can transport well fluid, for example, from one or more wellheads. As shown the system 110 can include a computational system 111 (CS), which can include one or more processors 112, memory 114 accessible to at least one of the one or more processors 112, instructions 116 that can be stored in the memory 114 and executable by at least one of the one or more processors 112, and one or more interfaces 118 (e.g., wired, wireless, etc.), which may be utilized, for example, for one or more types of communications with one or more of the different sub-systems and/or pieces of equipment of the surface system. In the example of FIG. 1, the system 110 is shown as including various communication symbols, which may be for transmission and/or reception of information (e.g., data, commands, etc.), for example, to and/or from the computational system 111. As an example, the computational system 111 can be a controller that can issue control instructions to one or more pieces of equipment in an environment such as, for example, the marine environment 102 and/or the land environment 104. As an example, the computational system 111 may be local, may be remote or may be distributed (e.g., in part local and in part remote, multiple local and/or remote locations, etc.).

Referring again to the wellhead 106, it can include various types of wellhead equipment such as, for example, casing and tubing heads, a production tree, a blowout preventer, etc. Fluid produced from a well can be routed through the wellhead 106 and into the system 110, which can be configured with various features for well testing operations.

In the example of FIG. 1, the system 110 is shown to include various segments, which may be categorized operationally. For example, consider a well control segment 120, a separation segment 122, a fluid management segment 124, and a burning segment 126. In such an example, one or more of the various segments may correspond to a sub-system or sub-systems. For example, consider the separation segment 122 corresponding to a separation sub-system.

As shown in the example of FIG. 1, the well control segment 120 is an assembly of various components such as a manifold 130, a choke manifold 132, a manifold 134, a heat exchanger 136 and a meter 138; the separation segment 122 includes a separator 142; the fluid management segment 124 is an assembly of various components such as pump manifolds and pumps 144, a tank manifold 146-1, a tank manifold 146-2, a tank 148-1 and a tank 148-2; and the burning segment 126 includes a burner 152 and one or more cameras 154. A manifold can be an arrangement of pipes and valves for the control of fluid circulation. A tank manifold enables control of fluid in and/or out of the tank while a pump manifold enables control of fluid in and/or out of the pumps.

As mentioned, in the example of FIG. 1, the system 110 includes various features for one or more aspects of well testing operations; noting that the system 110 may include lesser features, more features, alternative features, etc. In particular, each segment may include one or more sensors associated to particular equipment or locations in the segment. The sensors may sense information such as temperature, pressure, flow or state of equipment (e.g., for instance state of a valve). Other sensors may also be used as part of the system. For example, consider one or more of a gas specific gravity meter, a water-cut meter, a gas-to-oil ratio sensor, a carbon dioxide sensor, a hydrogen sulfide sensor, or a shrinkage measurement device. Various features may be upstream and/or downstream of a separator segment or a separator.

With respect to flow of fluid from a well or wells, such fluid may be received by the well control segment 120 and then routed via one or more conduits to the separation segment 122. In the example of FIG. 1, the heat exchanger 136 may be provided as a steam-heat exchanger and the meter 138 for measuring flow of fluid through the well control segment 120.

As mentioned, the well control segment 120 can convey fluid received from one or more wells to the separator 142. As an example, the separator 142 can be a horizontal separator or a vertical separator, and can be a two-phase separator (e.g., for separating gas and liquids) or a three-phase separator (e.g., for separating gas, oil, and water). A separator may include various features for facilitating separation of components of incoming fluid (e.g., diffusers, mist extractors, vanes, baffles, precipitators, etc.).

As an example, fluid can be single phase or multiphase fluid where "phase" can refer to an immiscible component (e.g., consider two or more of oil, water and gas for a multiphase fluid).

As an example, the separator 142 can be used to substantially separate multiphase fluid into its oil, gas, and water phases, as appropriate and as present, where each phase emerging from the separator 142 may be referred to as a separated fluid. Such separated fluids may be routed away from the separator 142 to the fluid management segment 124. In various instances, the separated fluids may not be entirely homogenous. For example, separated gas exiting the separator 142 can include some residual amount of water or oil and separated water exiting the separator 142 can include some amount of oil or entrained gas. Similarly, separated oil leaving the separator 142 can include some amount of water or entrained gas.

As shown in the example of FIG. 1, a system can include one or more manifolds, where depending on number of wells (e.g., 1, 2, 3, . . . , N), types of equipment, etc., a single manifold may suffice or there may be more than a single manifold. In the example of FIG. 1, the fluid management segment 124 can include flow control equipment, such as one or more manifolds and one or more pumps (generally represented by the block 144) for receiving fluids from the separator 142 and conveying the fluids to other destinations, optionally along with one or more additional manifolds 146-1 and 146-2, for example, for routing fluid to and from fluid tanks 148-1 and 148-2. As explained, the number of manifolds and tanks can be varied according to various factors. For instance, in one embodiment the fluid management segment 124 can include a single manifold and a single tank, while in other embodiments the fluid management segment 124 can include more than two manifolds and more than two tanks.

As to the manifolds and pumps 144, they can include a variety of manifolds and pumps, such as a gas manifold, an oil manifold, an oil transfer pump, a water manifold, and a water transfer pump. In at least some embodiments, the manifolds and pumps 144 can be used to route fluids received from the separator 142 to one or more of the fluid tanks 148-1 and 148-2 via one or more of the additional manifolds 146-1 and 146-2, and to route fluids between the tanks 148-1 and 148-2. As an example, the manifolds and pumps 144 can include features for routing fluids received from the separator 142 directly to the one or more burners 152 for burning gas and oil (e.g., bypassing the tanks 148-1 and 148-2) or for routing fluids from one or more of the tanks 148-1 and 148-2 to the one or more burners 152.

As noted above, components of the system 110 may vary between different applications. As an example, equipment within each functional group of the system 110 may also vary. For example, the heat exchanger 136 could be provided as part of the separation segment 122, rather than of the well control segment 120.

In certain embodiments, the system 110 can be a surface well testing system that can be monitored and controlled remotely. Remote monitoring may be effectuated with sensors installed on various components. In some instances, a monitoring system (e.g., sensors, communication systems, and human-machine interfaces) can enable monitoring of one or more of the segments 120, 122, 124 and 126. As shown in the example of FIG. 1, the one or more cameras 154 can be used to monitor one or more burning operations of the one or more burners 152, which may aim to facilitate control of such one or more burning operations at least in part through analysis of image data acquired by at least one of the one or more cameras 154. As an example, one or more cameras may be utilized for temperature monitoring. For example, consider an infrared camera that can utilize infrared wavelength emissions (e.g., consider approximately 1 μm to approximately 14 μm) to determine temperature where temperature may be utilized process control, safety, etc.

Figure 2:
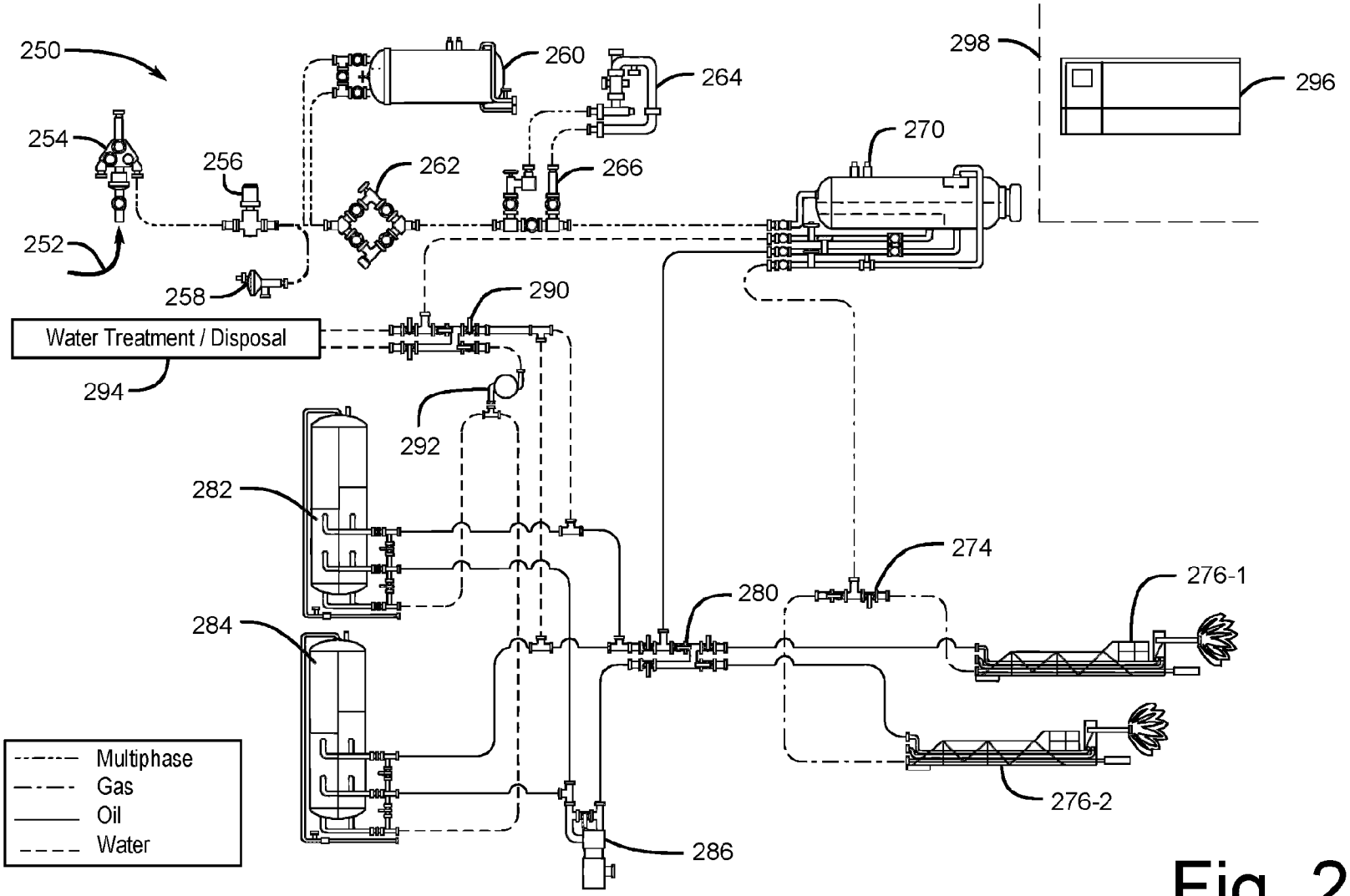
FIG. 2 is a diagram of an example of a surface system.

FIG. 2 shows an example of a system 250, which may be referred to as a surface well testing system. The system 250 can include various features of the system 110 of FIG. 1.

In FIG. 2, a multiphase fluid (represented here by arrow 252) enters a flowhead 254 and is routed to a separator 270 through a surface safety valve 256, a steam-heat exchanger 260, a choke manifold 262, a flow meter 264, and an additional manifold 266. In the example of FIG. 2, the system 250 includes a chemical injection pump 258 for injecting chemicals into the multiphase fluid flowing toward the separator 270, as may be desired.

In the depicted embodiment of FIG. 2, the separator 270 is a three-phase separator that generally separates the multiphase fluid 252 into gas, oil, and water components. The separated gas is routed downstream from the separator 270 through a gas manifold 274 to either of the burners 276-1 and 276-2 for flaring gas and burning oil. The gas manifold 274 includes valves that can be actuated to control flow of gas from the gas manifold 274 to one or the other of the burners 276-1 and 276-2. Although shown next to one another in FIG. 2 for sake of clarity, the burners 276-1 and 276-2 may be positioned apart from one another, such as on opposite sides of a rig, etc.

As shown, the separated oil from the separator 270 can be routed downstream to an oil manifold 280. Valves of the oil manifold 280 can be operated to permit flow of the oil to either of the burners 276-1 and 276-2 or either of the tanks 282 and 284. The tanks 282 and 284 can be of a suitable form, but are depicted in FIG. 2 as vertical surge tanks each having two fluid compartments. Such an approach allows each of the tanks 282 and 284 to simultaneously hold different fluids, such as water in one compartment and oil in the other compartment. An oil transfer pump 286 may be operated to pump oil through the well testing system 250 downstream of the separator 270. The separated water from the separator 270 can be similarly routed to a water manifold 290. Like the oil manifold 280, the water manifold 290 includes valves that can be opened or closed to permit water to flow to either of the tanks 282 and 284 or to a water treatment and disposal apparatus 294. A water transfer pump 292 may be used to pump the water through the system.

A well test area in which the well testing system 250 (or other embodiments of a well testing system) is installed may be classified as a hazardous area. In some embodiments, the well test area is classified as a Zone 1 hazardous area according to International Electrotechnical Commission (IEC) standard 60079-10-1:2015.

In the example of FIG. 2, a cabin 296 at a wellsite may include various types of equipment to acquire data from the well testing system 250. These acquired data may be used to monitor and control the well testing system 250. In at least some instances, the cabin 296 can be set apart from the well test area having the well testing system 250 in a non-hazardous area. This is represented by the dashed line 298 in FIG. 2, which generally serves as a demarcation between the hazardous area having the well testing system 250 and the non-hazardous area of the cabin 296.

The equipment of a well testing system can be monitored during a well testing process to verify proper operation and facilitate control of the process. Such monitoring can include taking numerous measurements by appropriate sensors during a well test, examples of which can include choke manifold temperature and pressures (upstream and downstream), heat exchanger temperature and pressure, separator temperature and pressures (static and differential), oil flow rate and volume from the separator, water flow rate and volume from the separator, and fluid levels in tanks of a system.

As an example, a system can be configured for local and/or remote rendering of information, control, etc. For example, consider a mobile computing device such as a tablet computing device that can be operatively coupled to remote computing resources via a wired network, a wireless network, etc. In such an example, the remote computing resources may be or include a multicloud management platform (MCMP, e.g., an IBM MCMP, etc.; International Business Machines Corporation, Armonk, New York). In such an example, a mobile computing device can include hardware suitable to execute a browser application or another type of application suitable for rendering graphical user interfaces to a display, which may be a touchscreen display. For example, consider a browser application executing on a mobile computing device that a user can interact with a MCMP for one or more purposes. In such an approach, the mobile computing device may provide for interactions for one or more of equipment maintenance, equipment sensor data, equipment control (e.g., set points, etc.), etc. In such an approach, a user may assess equipment using a mobile computing device, which can provide the user flexibility as to the user's location, which may be, for example, remote from an equipment site. Using a mobile computing device, a user may "check" various types of equipment that are at a site on a daily basis or a less frequent basis and/or a more frequent basis.

Figure 3:
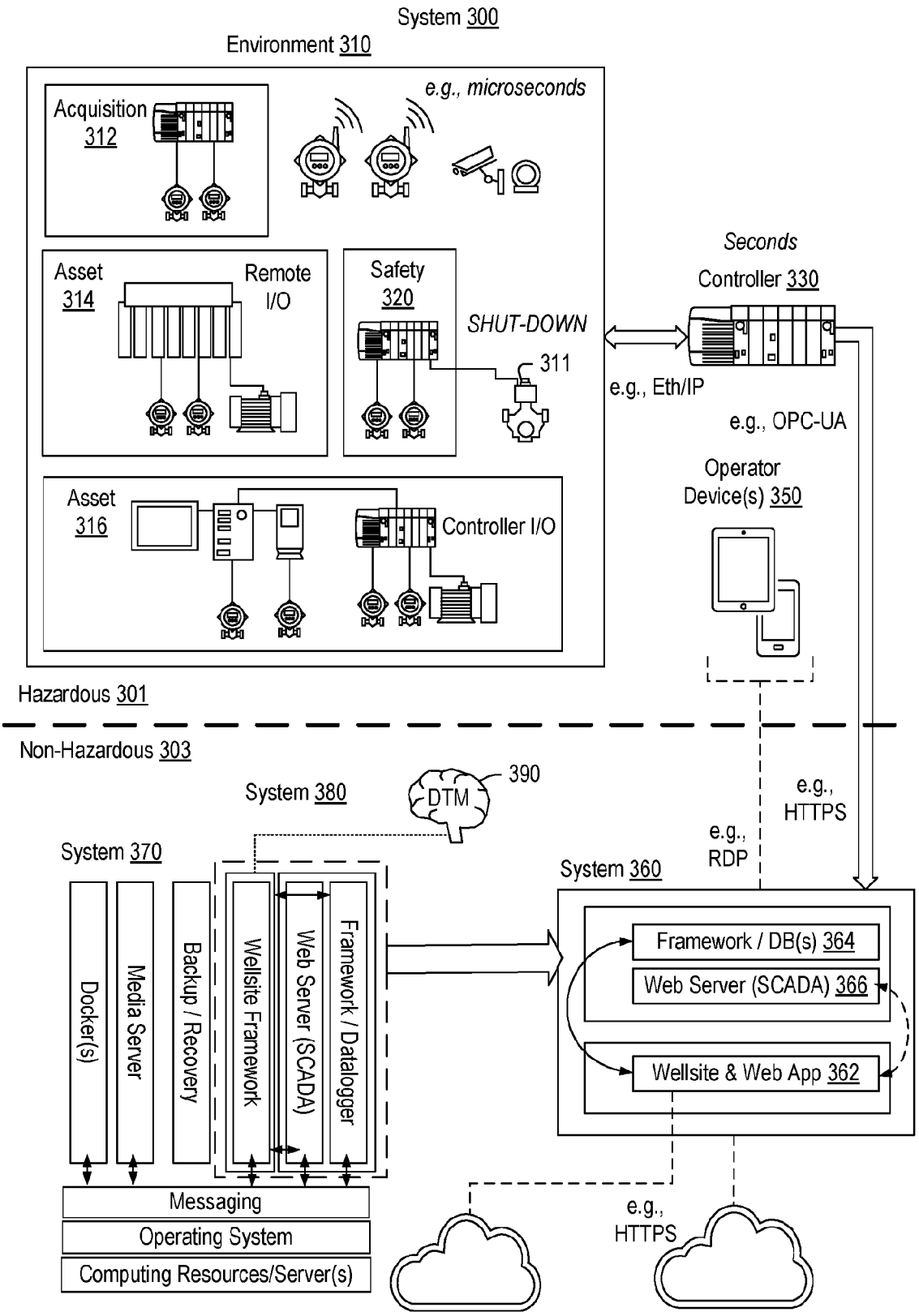
FIG. 3 is a diagram of an example of a system.

FIG. 3 shows an example of a system 300 that includes a hazardous area 301 and a non-hazardous area 303; noting that various types of computing equipment, network equipment, etc., can be positioned or re-positioned into one or more of the areas 301 and 303. As mentioned, a cabin can be included in an area, which may help to protect one or more people, equipment, etc., from one or more hazards, or, for example, a cabin may be in an area characterized as being non-hazardous.

In the example of FIG. 3, the system 300 is illustrated as an architecture with various type of equipment. For example, an environment 310 is shown as including equipment that can perform various actions with respect to well operations such as, for example, well testing.

Where such a system does not include various features of the system 300, one or more operators may be present for one or more manual tasks as to operations in the environment 310. Such tasks can be referred to as jobs, which may be designated using the French word "métier", which can mean job, for example, the job of testing a well. In performing such tasks (e.g., jobs), an operator can have knowledge and expertise as to how equipment behaves under certain conditions, how fluid behaves under certain conditions, how combustion behaves under certain conditions, etc. Such an operator may be instructed to or understand how to take one or more actions in the environment 310, which may be for optimization of one or more processes and/or for reduction of risk, for example, in an emergency situation. As a system can include numerous sub-systems, coordinate action may be demanded to properly optimize and/or to reduce risk. However, where coordinated action is via a crew, there can be considerable demands placed on members of the crew, particularly with respect to timing, adjustments, communications, etc. For example, an action taken by a first operator at a first sub-system may impact how fluid flows to a second sub-system, which may be managed by a second operator. If the second operator does not expect the impact, the second operator may view changes as being an emergency and call for a system-wide shut down or the second operator may make one or more changes that cascade to one or more other sub-systems.

In a system, overarching control, which may be referred to as supervisory control, and sub-system control may be implemented, optionally with one or more independent safety systems. In such an example, one or more digital twins with métier (DTM) can be implemented, which can operate at least in part on a sub-system level. The DTM can be a model or models replicating virtually one or more pieces of equipment at the well site. Such a DTM may be used to run simulations and may be trained to determine an optimal behavior of the equipment and/or the system 300 based on current sensed parameters, etc. For example, consider a DTM of a separator that has been trained (e.g., via machine learning) to possess knowledge and expertise of an operator that is skilled in the operation of the separator. In such an example, the DTM may be localized and operate in a manner that is knowledge, expertise and data-based. For example, sensor data can be acquired for the separator and input to a model that can output one or more parameter values that can be utilized to control the operation of the separator. In such an example, the separator can be controlled as an autonomous surface system (e.g., an autonomous surface subsystem). Such a DTM approach can be robust and capable of handling events such as, for example, shut down at a wellhead, optionally without receipt of a communication of that event. For example, the DTM may be robust in that it can respond to locally acquired data and understand what parameter values will result in optimal operation of the separator, whether for purposes of well testing or other operation(s) (e.g., shut down, startup, etc.).

In the example of FIG. 3, the environment 310 includes flow control equipment 311 (e.g., capable of performing a shut down and/or other process action), which can be in fluid communication with one or more wells, for example, to provide well fluid to one or more pieces of equipment in the environment 310. As shown, the environment 310 can include various data acquisition equipment 312, one or more assets 314 and 316 (e.g., sub-systems, etc.), and a safety system 320 operatively coupled to the flow control equipment 311. As an example, where a condition arises, or conditions arise, that warrant action as to safety, the safety system may issue a control instruction to shut-down fluid flow using the flow control equipment 311 (e.g., a choke valve, etc.).

In the example of FIG. 3, the environment 310 can include one or more types of controllers, which may be operatively coupled to various equipment. Such controllers (e.g., controller units, controller systems, etc.) can be manufactured and/or otherwise protected for purposes of operating in the environment 310.

As shown, the system 300 can include a controller 330, which can be a controller system that is operatively coupled to equipment in the environment 310 via one or more communication technologies. For example, consider wire and/or wireless technologies, which may utilize one or more types of communication protocols. For example, consider EtherNet/IP where "IP" is an abbreviation of "Industrial Protocol", which is an industrial network protocol that adapts the Common Industrial Protocol (CIP) to Ethernet. As an example, the controller 330 may be a supervisory level controller.

As an example, in the system 300, an operator may be present in the environment 310 or in a vicinity of the environment 310 and utilize one or more computing devices 350, which may be operatively coupled to equipment in the hazardous area 301 and/or the non-hazardous area 303 (e.g., directly, indirectly, etc.) via one or more interfaces. For example, consider a mobile device that can communicate with the controller 330 and/or the safety system 320, which may be via direct and/or indirect communication (e.g., wired and/or wireless).

FIG. 3 also shows various communications that may utilize one or more technologies such as, for example, one or more of HTTPS, Remote Desktop Protocol (RDP), an OPC Unified Architecture (OPC-UA), etc.

The Hypertext Transfer Protocol Secure (HTTPS) is an extension of the Hypertext Transfer Protocol (HTTP) and can be used for secure communication over a computer network. In HTTPS, the communication protocol can be encrypted using a security technology such as Transport Layer Security (TLS) or Secure Sockets Layer (SSL).

The Remote Desktop Protocol (RDP) is a proprietary protocol developed by Microsoft Corporation (Redmond, Washington) that can provide for rendering a graphical interface to connect to another computer over a network connection. The RDP involves use of RDP client software and RDP server software (e.g., also consider HTTPS, etc.). Clients exist for various operating systems (OSs) (e.g., WINDOWS, LINUX, UNIX, macOS, iOS, ANDROID, etc.). RDP servers can be built into an OS (e.g., WINDOWS OS, UNIX OS, etc.), where a server can listen on a TCP port and a UDP port. The RDP is an extension of the ITU-T T.128 application sharing protocol.

OPC-UA is a machine to machine communication protocol for industrial automation developed by the OPC Foundation. It can provide for communications between industrial equipment and systems for data collection and control, be cross-platform, provide a service-oriented architecture (SOA), and provide for various security measures.

OPC-UA can utilize an integral information model for modeling data into an OPC-UA namespace for the SOA. OPC-UA supports protocols such as a binary protocol (e.g., opc.tcp://server) and an HTTP protocol (e.g., http://server) for web service. OPC-UA can operate transparent to an application programming interface (API). As an example, EtherNet/IP may be utilized, optionally according to one or more API specifications.

A binary protocol can offer lesser overhead and demand fewer resources (e.g., no XML Parser, SOAP and HTTP), which can facilitate operations for embedded devices. A binary protocol can offer interoperability and use a single arbitrarily choosable TCP port for communication easing tunneling or easy enablement through a firewall.

As an example, the web service (SOAP) protocol may be utilized and be supported from available tools (e.g., JAVA or .NET environments) and can be firewall-friendly (e.g., using HTTP(S) ports).

In the example of FIG. 3, the non-hazardous area 303 is shown as including various systems 360, 370 and 380 along with a digital twin métier (DTM) 390 (e.g., or a plurality of DTMs, etc.). The DTM 390 can be built using one or more systems and then deployed for use locally with respect to wellsite equipment in the environment 310. For example, the DTM 390 can be a model, which may be, for example, an algorithm (e.g., handcoded decision tree, etc.) or a trained machine learning model (trained ML model) that can be deployed to one or more controllers, which may be in the hazardous area 301 and/or optionally in a cabin, etc., which may be a "safe" area within the hazardous area 301 or in an area adjacent to the hazardous area 301.

As an example, the DTM 390 can be deployed to the controller 330, which, as mentioned, can be a primary controller for the environment 310 (e.g., a supervisory level controller). As explained, for reasons of safety, the safety system 320 may operate where one or more conditions arise that can elevate risk. For example, the safety system 320 may respond to the controller 330 going down (e.g., loss of power, operational error, etc.) and/or may respond to the controller being unable to sufficiently control a condition or conditions, which can include one or more types of trending conditions of the environment 310. As to operations, the safety system 320 may cause cessation of fluid flow via the flow control equipment (e.g., a choke, etc.).

As mentioned, the DTM 390 may be representative of a sub-system within the environment 310 where it may provide for an autonomous surface sub-system. As mentioned, a separator can be modeled as a digital twin where operator knowledge and expertise as embodied in tasks, jobs, etc., to be performed by the operator are also modeled such that the digital twin is a digital twin with métier (DTM). As mentioned, the environment 310 can include various sub-systems and one or more DTMs may be each representative of one or more of the sub-systems.

As to various components, systems, etc., in the non-hazardous area 303, as shown in FIG. 3, the system 360 can include a component 362 for a wellsite framework and one or more web applications, which can be operatively coupled to a component 364 for a data framework that can include or be operatively coupled to one or more databases (DBs). As shown, the system 360 can include a component 366 for a web server that may operate according to a supervisory control and data acquisition (SCADA) architecture, which can provide for interactions between computing devices, controllers, networked data communications equipment, graphical user interfaces (GUIs), etc. A SCADA architecture can provide for high-level process supervisory management, while also including other peripheral devices like programmable logic controllers (PLC) and discrete proportional-integral-derivative (PID) controllers (e.g., one or more of P, I, D, F, etc.) to interface with equipment.

In the example of FIG. 3, the system 360 can be in communication with the controller 330 (e.g., OPC-UA, etc.) and via one or more of the operator devices 350 (e.g., RDP, HTTPS, etc.). The system 360 can utilize one or more virtualization technologies such as, for example, virtual machines (VM) and/or containerization. As an example, a system may include hardware virtual machines and/or process virtual machines.

As an example, a VM may run a complete operating system, including its own kernel. As an example, a container can be an isolated, lightweight silo for running an application on a host operating system (host OS). As an example, a container may build on top of a host OS's kernel and include apps and, for example, some lightweight OS APIs and services that may run in a user mode.

The system 360 can be implemented using various resources, which can include cloud-based resources. As an example, the system 360 may be in part implemented using cloud-based resources (e.g., servers of a server farm, data storage devices of a server farm, etc.). As an example, the system 360 can be accessible via one or more protocols (e.g., via wire or wirelessly) such that remote interactions can occur (e.g., for remote management, etc.), which may be via a cloud environment (e.g., GOOGLE, AMAZON, MICROSOFT, etc.).

As to the component 364, it can include various features of the Rockwell Automation suite (e.g., FactoryTalk suite, etc., Rockwell Automation, Milwaukee, Wisconsin). Such features may be suitable for interactions with a controller system, a controller unit, etc., which may be a Rockwell Automation controller system, controller unit, etc. (e.g., consider one or more Allen-Bradley products, etc.).

As an example, the component 364 can provide for organizing data at equipment and/or enterprise levels. The component 364 can include historian features for collecting time-series data for various calculations, estimations, and statistical processes. The component 364 may provide for reporting and trending reports.

As an example, the component 364 can provide for predictions such as, for example, anomaly predictions, equipment degradation predictions, etc. As an example, the component 364 can include an embedded analytics feature, which can provide analytics for use in training a machine learning model, operating a trained machine learning model, etc.

In the example of FIG. 3, the system 370 can include various features for media, applications and dockers, which may be operatively coupled to a component labeled as message bus/message queue, which can be a message broker resource (e.g., message-oriented middleware) that can implement the Advanced Message Queuing Protocol (AMQP) and be extended with a plug-in architecture to support Streaming Text Oriented Messaging Protocol (STOMP), MQTT, and other protocols. Such a component can be operable using a LINUX operating system environment, which may be implemented using a component such as a multicloud management platform (MCMP, International Business Machines Corporation, Armonk, New York), which can utilize one or more servers. The MCMP can be operable using one or more cloud environments (e.g., GOOGLE, AMAZON, MICROSOFT, IBM, etc.) and be browser accessible via one or more browser applications (e.g., CHROME, FIREFOX, EDGE, SAFARI, etc.).

In the example of FIG. 3, the system 380 can include various features of the system 360 such as, for example, a data framework, a datalogger (e.g., a historian, etc.), a web server (e.g., SCADA, etc.), and a wellsite framework. As an example, the system 380 can be a cloud-based system that can provide for building one or more DTMs 390, which can then be deployed to a particular wellsite or wellsites. As an example, a particular wellsite can include an instance of the system 380 appropriately scaled for the particular wellsite. As an example, the system 360 can include features for selecting the DTM 390, building the DTM 390, tailoring the DTM 390, deploying the DTM 390, operating the DTM 390, etc.

In the example of FIG. 3, as explained, the DTM 390 can be utilized for controlling one or more pieces of equipment in the environment 310. As mentioned, the DTM 390 may be a relatively light-weight object that can be implemented using an operating system of one or more pieces of equipment, a controller unit, a controller system, etc. As explained, the environment 310 can include the safety system 320 for purposes of assuring that safety guidelines are implemented where, for example, an issue may arise whereby control via the DTM 390 and/or one or more other control mechanisms may be inadequate. As explained, a sub-system in the environment 310 can include a specialized DTM that can be robust and provide for autonomous operation of the sub-system where an event may occur such as a shut down by the safety system 320. In such an example, safety within the environment 310 can be enhanced as a sub-system DTM may provide for control of the sub-system in a manner that reduces risk to the sub-system, to one or more operators (e.g., if present or later present), to the environment (e.g., spillage, flaming, etc.), etc.

As an example, the system 300 can include logic, for example, at a PLC level, that can be sufficient to manage a safe shut down. For example, consider a scenario where a network connection is lost or otherwise compromised. In such an example, DTM control may be confounded such that logic at a PLC level can address such a scenario, particularly where an emergency shutdown (ESD) system operates to shut off flow from a well. In such an example, consider a separator as a sub-system that had been in fluid communication with the well where the separator can itself be controlled appropriately, for example, to have a controlled shutdown that aims to reduce one or more risks such as a spill risk, an overpressure risk, etc.

Figure 4:
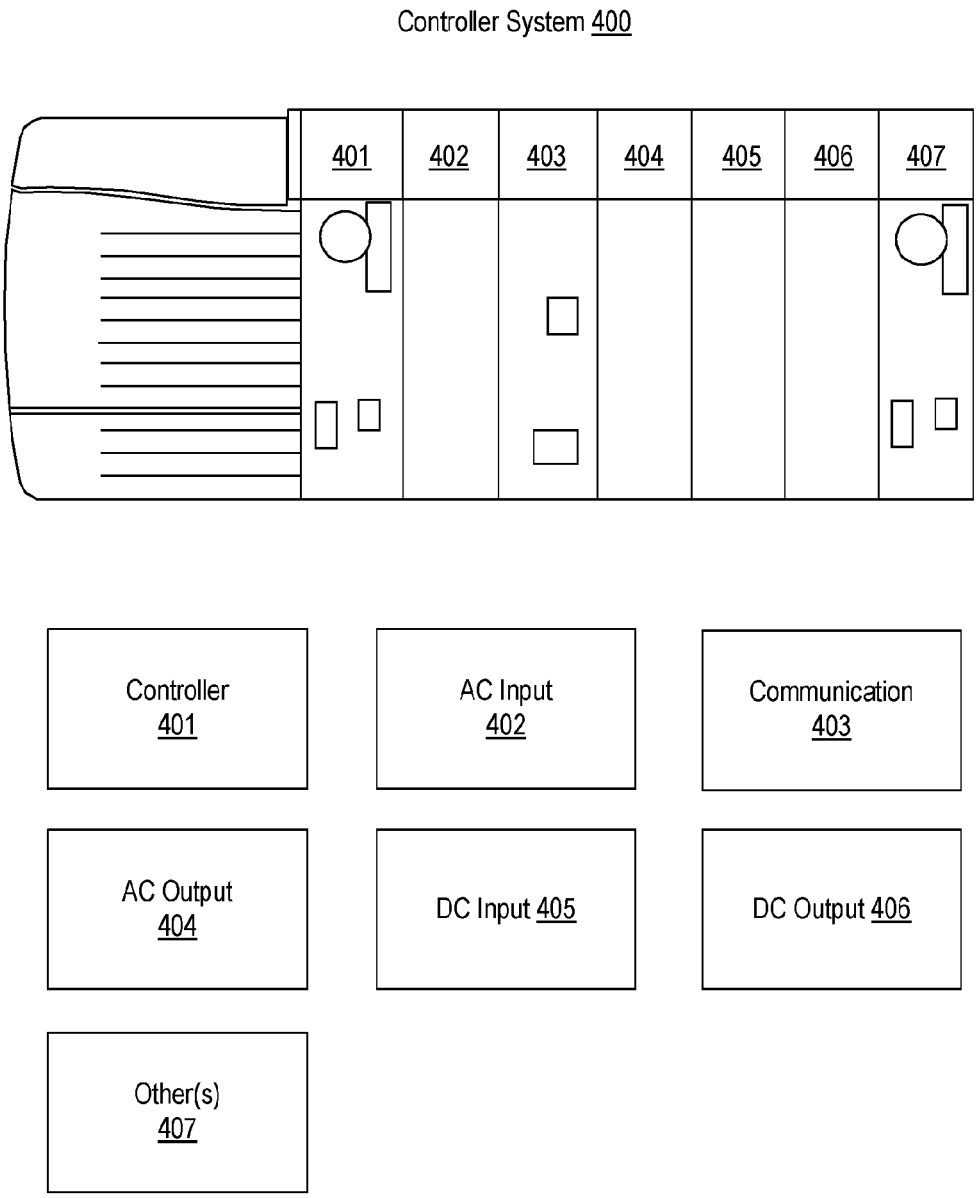
FIG. 4 is a diagram of an example of a controller system.

FIG. 4 shows an example of a controller system 400 that includes various units. As an example, the controller system 400 can include various units that can be assembled in a manner where the units can be operatively coupled for one or more purposes. As shown in FIG. 4, the controller system 400 includes a controller unit 401, an AC input unit 402, a communication unit 403, an AC output unit 404, a DC input unit 405, a DC output unit 406, and one or more other units 407. As an example, a controller system (e.g., control system) may provide for analog and/or digital input and/or output.

As an example, a DC input unit may allow for connection of PNP (sourcing) and/or NPN (sinking) transistor type devices (e.g., a sensor, a switch, etc.). As an example, an AC input unit can handle non-polarized AC voltage where, for example, the AC voltage is being switched through a limit switch or other switch type. AC input units tend to be less common than DC input units as various sensors can have transistor output(s). For example, a sensor may be operating on a DC voltage and provide a DC output that can be received via a DC input unit The controller system 400 may be suitable for use as the controller 330 of the system 300 of FIG. 3 and/or for use as a sub-system controller (see, e.g., assets 314, 316, etc.).

As an example, the controller system 400 can include one or more types of circuitry, features, etc., of a controller system (e.g., compact logic, PLC, etc.). As an example, a controller system can include a controller unit, a communication unit, a power supply unit, one or more discrete input units, one or more removable terminal blocks for a discrete input unit, a discrete output unit, one or more removable terminal blocks for a discrete output unit, an analog input unit, executable instructions stored in memory, one or more redundant units (e.g., for redundant control, redundant power, redundant communication, etc.), etc.

As an example, a controller unit, a controller system, etc., can be or include one or more programmable logic controller (PLC) units. As an example, a controller system may be configured with particular units for dedicated use, for example, as a safety controller that can call for one or more types of actions relating to safety. Such a controller may be independent of one or more other controllers such that, where a primary controller fails, the safety controller can be independent and take appropriate action. As to a failure of a primary controller, such a failure can be for one or more reasons, which can include, for example, failure of the controller itself or failure of the controller to adequately control one or more processes.

As an example, the controller system 400 can include one or more DTMs such as, for example, the DTM 390 of FIG. 3. In such an example, the DTM can be an algorithm that is handcoded, etc. (e.g., a decision tree model with predefined criteria, etc.) or be a trained machine learning model (e.g., a decision tree, one or more neural networks, etc.). As an example, a DTM may evolve from being a relatively basic structure to being a more complex structure that can model more "métier" as it evolves. As an example, a DTM may learn using data such that it evolves to possess an ability to handle scenarios beyond those of a certain level of skilled operator. For example, using learning, a DTM may make inferences beyond those of a skilled operator such that the DTM can output parameter values for optimal operational conditions that are not readily achieved (e.g., in limited amount of time, etc.) by a skilled operator. As mentioned, a DTM may provide for robust autonomous control responsive to one or more other actions taken with respect to one or more other sub-systems, which can include, for example, a shut down event where flow at a wellhead is shut down (e.g., reduced to approximately zero).

As explained, a DTM can be based on data and can operate responsive to data being input such that the DTM can generate output. As to various types of data, data can include fluid data as acquired by a flow meter as flow, amount of flow, characteristics of flow, characteristics of fluid, etc., can be indicators as to how a system or a sub-system is behaving.

Figure 5:
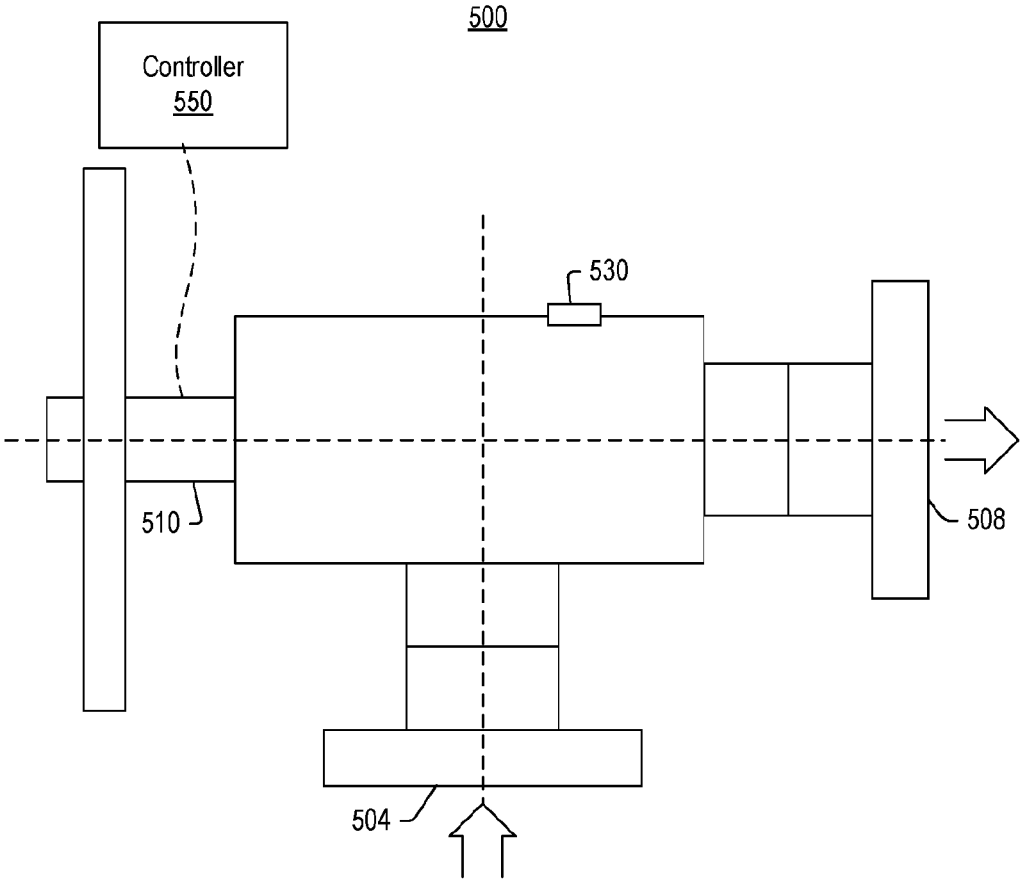
FIG. 5 is a diagram of an example of a valve.

FIG. 5 shows an example of a choke valve 500. One or more choke valves can be included in a system such as the system 110 of FIG. 1, the system 250 of FIG. 2, etc. A choke valve can be located on or near a Christmas tree that is used to control the production of fluid from a well. Opening or closing of a choke valve can influence rate and pressure at which production fluids progress through a pipeline, a process facility, etc. An adjustable choke valve (e.g., an adjustable choke) may be linked to an automated control system to enable one or more production parameters of a well to be controlled.

In the example of FIG. 5, the choke valve 500 includes openings 504 and 508 to corresponding passages where the passages 504 and 508 can be in fluid communication via adjustment of a stem 510, which may be operatively coupled to one or more types of mechanisms. For example, consider a plug and cage mechanism, a needle and seat mechanism, etc.

A plug and cage choke valve can include a plug that is operatively coupled to a stem to move the plug with respect to a cage, which may be a multi-component cage (e.g., consider an inner cage, an outer cage, etc.). In such an example, the cage can include a plurality of openings, which may be of one or more sizes. For example, consider a ring of smaller openings and a ring of larger openings where the different size openings may provide for finer adjustments to flow. In such an example, the plug may first provide for opening of the smaller openings to provide for fluid communication between passages and then, upon further axial translation, provide for opening of the larger openings to provide for more cross-sectional flow area for fluid communication between the passages. As an example, a stem of a plug and cage choke valve can be rotatable where rotation causes axial translation to position the plug with respect to the cage.

A needle and seat choke valve can include a needle portion that can be part of a stem or otherwise operatively coupled to a stem where the stem can be threaded such that rotation causes translation of the needle portion with respect to the seat. When the needle portion is initially translated an axial distance, an annulus is created that causes passages to be in fluid communication. Upon further translation, the needle portion may be completely removed from a bore of the seat such that the annular opening becomes a cylindrical opening, which provides for greater cross-sectional flow area for fluid communication between the passages.

As an example, a choke valve may include one or more sensors that can provide for one or more measurements such as, for example, one or more of position (e.g., stem, needle portion, plug, etc.), flow, pressure, temperature, etc.

As an example, a choke valve may be a unidirectional valve that is intended to be operated with flow in a predefined direction (e.g., from a high pressure side to a lower pressure side).

A choke valve may be selected such that fluctuations in line pressure downstream of the choke valve have minimal effect on production rate. In operation, flow through a choke valve may be at so-called critical flow conditions. Under critical flow conditions, the flow rate is a function of upstream pressure or tubing pressure. For example, consider a criterion where downstream pressure is to be approximately 0.55 or less of tubing pressure.

As an example, a multiphase choke equation may be utilized to estimate the flowing wellhead pressure for a given set of well conditions along with suitable multiphase choke coefficients (e.g., Gilbert, Ros, Baxendell, Achong, etc.), which include coefficients $A_1$, $A_2$ and $A_3$. For example, consider the following equation with parameter values inserted, as explained below.

$$p_{wh}=(3.86\times10^{-3}(400)(800^{0.546})/((12/64)^{1.89})=1{,}405 \text{ psia}$$

In the foregoing equation, which may be used to estimate flow rate or choke diameter, the well is producing 400 STB/D of oil with a gas-liquid ratio of 800 Scf/STB where the choke size is 12/64 inch and the Gilbert coefficients are $3.86\times10^{-3}$, 0.546 and 1.89, respectively. As indicated, the estimated flowing wellhead pressure is 1,405 psia. In an example using the Ros choke equation, an estimated flowing wellhead pressure of 1,371 psia is calculated.

Parameters that can be utilized in various computations include, discharge coefficient (Cd), pipe diameter (d), pipe length (L), specific heat capacity ratio (k) (e.g., Cp/Cv), standard pressure (psc), wellhead pressure (pwh), gas flow rate (qg), liquid flow rate (ql), standard temperature (Tsc), wellhead temperature (Twh), ratio of downstream pressure to upstream pressure (y), gas compressibility factor (z), gas specific gravity (yg), etc.

In the example of FIG. 5, the choke valve 500 includes a port 530 that may be utilized for monitoring pressure. As shown in FIG. 5, a controller 550 may be utilized to control the stem 510. For example, consider a motor that can be operatively coupled to the stem 510 such that the motor can be controlled to adjust the stem 510 (e.g., to adjust the shape and size of the opening or openings between the passages 504 and 508, etc.).

Figure 6:
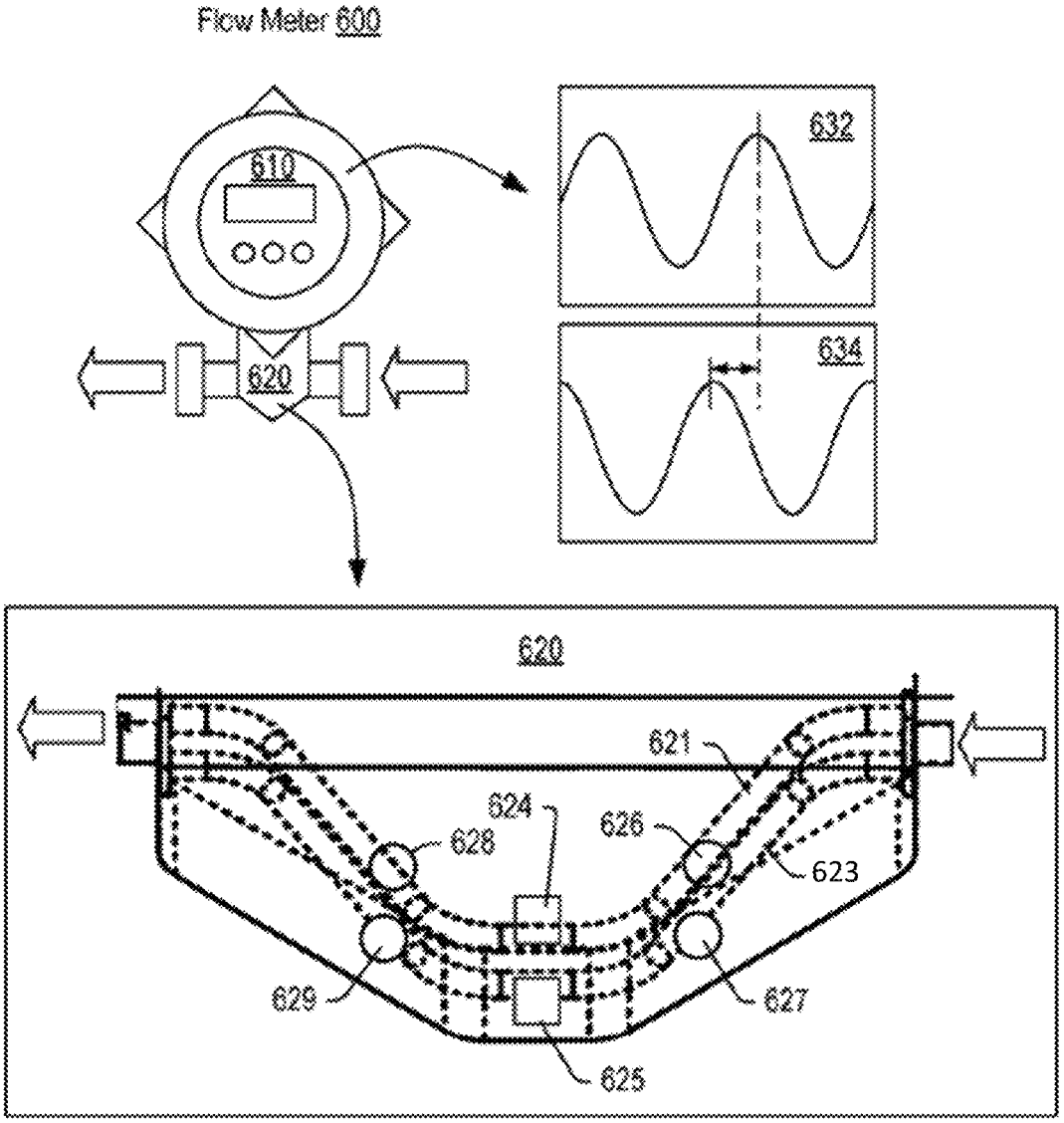
FIG. 6 is a diagram of an example of a flow meter.

FIG. 6 shows an example of a flow meter 600 that includes circuitry 610 and a U sensor tube assembly 620. As shown, the U sensor tube assembly 620 includes a pair of U sensor tubes 621 and 623 along with various driver components 624 and 625 and various sensor components 626, 627, 628 and 629.

A mentioned, a system can include one or more types of flow meters. For example, the system 300 of FIG. 3 shows various flow meters in the environment 310. A flow meter can be a type of meter that can measure fluid flow and that can optionally measure one or more other types of physical characteristics and/or phenomena (e.g., pressure, temperature, density, vibration, orientation, etc.).

As shown in FIG. 6, the flow meter 600 can include one or more sensor tubes (e.g., U sensor tubes, etc.) 621 and 623. For example, consider the flow meter 600 as including the pair of U sensor tubes 621 and 623 that can be provided with a split of incoming flow where the U sensor tubes 621 and 623 oscillate at a natural resonant frequency via the driver components 624 and 625. In such an example, the flow meter 600 can include the sensor components 626, 627, 628 and 629 as magnet and coil assembly pickoffs that can measure voltage amplitudes with respect to time (e.g., sine waves, etc.). When fluid flows in the pair of U sensor tubes 621 and 623, the Coriolis force causes each of the U sensor tubes 621 and 623 to twist in opposition to each other, which results in a phase shift for voltage amplitudes with respect to time (e.g., phase shifted sine waves), which are shown in the plots 632 and 634. In such an example, a time delay between phases can be measured in microseconds where the time delay is proportional to the mass flow rate (e.g., a greater time delay can correspond to a greater mass flow rate). In such an example, frequency can be measured where frequency can provide an indication of density. For example, consider Hooke's law where a tube can be a spring and mass of a tube and fluid therein can be considered a mass coupled to the spring. In such an example, density can be estimated as being proportional to the inverse of the frequency squared. As an example, volumetric flow can be determined from mass flow rate and density (e.g., volumetric flow rate=mass flow rate/density).

A flow meter may be characterized by a flow rate turndown ratio (e.g., up to 100:1 or more, etc.). A flow meter may be rated as to temperature and can include one or more temperature sensors. As an example, a flow meter may be suitable for operation over a range of temperatures from minus 200 degrees C. to plus 350 degrees C. A flow meter may include one or more types of interfaces, busses, etc.

As an example, a flow meter can include circuitry that can measure flow over a range of flow rates. For example, consider a range with a lower limit that can be as low as zero and an upper limit that can be as high as, for example, 400,000 barrels per day (BPD) or more.

As an example, a flow meter can be rated with an uncertainty. For example, consider a flow rate uncertainty on liquids of approximately +/−0.1 percent (e.g., +/−zero stability error). As to density, consider, for example, a density uncertainty of approximately +/−0.0005 g/ml.

As an example, a flow meter can be constructed of various different materials where one or more of the materials can be exposed to fluid and considered to be fluid-wetted. As an example, a flow meter can include one or more fluid-wetted materials such as, for example, one or more of a stainless steel and an alloy (e.g., consider 316/316L SST or Alloy C22).

As an example, a flow meter may be suitable for use in one or more types of hazardous areas where a hazardous area may be characterized according to one or more standards (e.g., CSA, ATEX/IECEx). In North America, hazardous locations can be defined by a combination of classes and divisions or zones, for example, as follows: Class I (a location made hazardous by the presence of flammable gases or vapors that may be present in the air in quantities sufficient to produce an explosive or ignitable mixture); Class II (a location made hazardous by the presence of combustible or electrically conductive dust); Class III (a location made hazardous by the presence of easily ignitable fibers or flyings in the air, but not likely to be in suspension in quantities sufficient to produce ignitable mixtures); Division 1 (a location where a classified hazard exists or is likely to exist under normal conditions); Division 2 (a location where a classified hazard does not normally exist but is possible to appear under abnormal conditions); Zone 0 (an area in which an explosive gas atmosphere is continuously present for a long period of time); Zone 1 (an area in which an explosive atmosphere is likely to occur in normal operation); Zone 2 (an area in which an explosive gas atmosphere does not normally exist); etc.

As an example, a flow meter can include circuitry that can perform I/O counts, for example, consider one or more of dual independent pulse outputs, dual independent analog outputs, status input, and status output.

As an example, a system can include one or more pressure sensors, temperature sensors or other types of sensors. As an example, a sensor unit may be a combination unit that includes different types of sensors. For example, consider a sensor unit that includes a pressure sensor and a temperature sensor. As an example, a sensor or sensor unit may be suitable for use at surface and/or downhole.

Metrology is the science and process of ensuring that a measurement meets specified degrees of accuracy and precision. Bottom hole pressure-gauge and temperature-gauge performance can depend on various static metrological parameters and/or various dynamic metrological parameters. As an example, a pressure measurement unit can include one or more pressure transducers, associated electronics, and telemetry circuitry where various components of the unit can influence one or more of range, accuracy, precision, sampling rate, telemetry, etc.

As to a unit that provides for both pressure and temperature sensing, a measured temperature can be utilized to adjust a measured pressure where, for example, the temperature measured corresponds to that of a pressure-sensing element, which may differ from the measured temperature of wellbore fluid. As to bottomhole-fluid temperature measurements, these may be performed using one or more sensors that are in immediate contact with wellbore fluid. As an example, a temperature sensor can be designed to possess a relatively small thermal inertia (e.g., 1 to 2 seconds, etc.) such that it can follow variations of fluid temperature as closely as possible. As such, temperature measurements available from pressure-gauge technology can be sub-optimal for wellbore temperature profiling, which uses wellbore fluid temperature (e.g., as a diagnostic tool to detect anomalies in the expected flow patterns in and around a wellbore). As an example, a pressure sensor may have an accuracy of a few psi and a resolution of approximately 0.05 psi. As an example, a wellbore-fluid temperature sensor may have a resolution of approximately 0.05 degrees F. and an accuracy of approximately 1 degree F.

As an example, a controller, a choke valve, a flow meter, a sensor, a sensor unit, etc., can include a serial interface such as, for example, a Modbus RS-485 interface.

As an example, a controller, a choke valve, a flow meter, a sensor, a sensor unit, etc., can be compliant with one or more standards. For example, consider equipment compliant with the HART communication protocol (Highway Addressable Remote Transducer), which is a hybrid analog and digital industrial automation open protocol. The HART approach can be utilized with 4 mA to 20 mA analog instrumentation current loops, for example, sharing a pair of wires used by an analog host system.

As an example, a DTM may include capabilities to communicate with one or more sensors, one or more actuators, etc. For example, the DTM 390 of FIG. 3 may include capabilities to communicate the controller 550 of FIG. 5, with one or more flow meters such as the flow meter 600 of FIG. 6, etc. In such an example, the DTM may drive data acquisition for input to the DTM.

Figure 7:
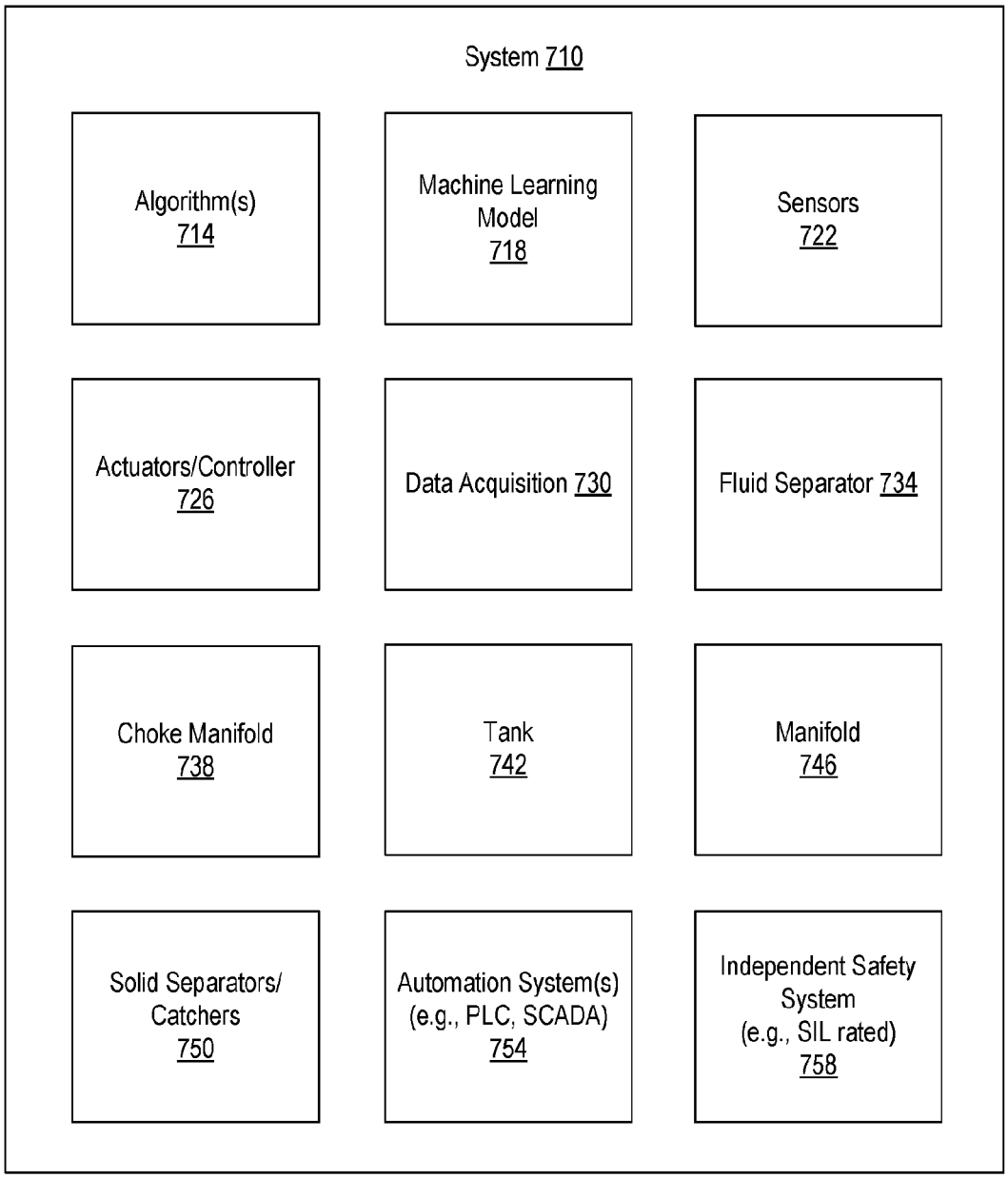
FIG. 7 is a diagram of an example of a system.

FIG. 7 shows an example of a system 710 that can include one or more algorithms 714 (e.g., models such as decision tree models with hardcoded criteria, etc.), one or more machine learning models 718, one or more sensors 722, one or more actuators and/or controllers 726, one or more data acquisition units 730, one or more fluid separators 734, one or more choke manifolds 738, one or more tanks 742, one or more manifolds 746, one or more solid separators and/or catchers 750, one or more automation systems 754 (e.g., controller systems, etc.), and one or more independent safety systems 758 (e.g., SIL rated, etc.).

As an example, the system 110 can include various features of the system 710. As an example, the system 250 can include various features of the system 710. As an example, the system 300 can include various features of the system 710.

In the example of FIG. 7, the system 714 can utilize handcoding and/or machine learning. For example, one or more of the algorithms 710 can include one or more coded decision trees (e.g., decision tree models), etc., which may be developed using knowledge, expertise, etc., of one or more crew members that perform field operations on a system such as the system 110 of FIG. 1, the system 250 of FIG. 2, the system 300 of FIG. 3, etc.

As an example, a bootstrap approach may be implemented where a specification is utilized for purposes of setting up various controller units, controller systems, field sensors, field actuators, etc. In such an example, the specification can be based on knowledge and expertise with a goal of automation. In such an approach, the specification can include a decision tree that can be operable using acquired data to make decisions as to values of one or more parameters that can be implemented in an effort to optimize an operation. As various types of machine learning models demand sufficient training data, adherence to the specification and decision tree across a number of installations can provide for generation of data organized in a manner sufficient to train one or more machine learning models.

As an example, a bootstrap approach can be tiered. For example, consider a first tier as including a specification that is aligned with equipment and operational tasks of one or more operators (e.g., one or more crew members, etc.). Implementation of the first tier can provide for a second tier that includes generating, refining, etc., a decision tree model or other suitable decision making algorithm that can receive input based on acquired data to output parameter values. Implementation of the second tier can provide for a third tier that includes generating one or more trained machine learning models that are aligned with equipment and trained to make decisions, which can include at least some decisions corresponding to operational tasks of one or more operators. In such an example, a hand-off can occur incrementally to transition control from manual control toward autonomous control.

Where some amount of autonomous control is implemented, a system can provide for self-adjusting, which can include calling for additional learning, selecting an updated trained machine learning model, selecting a different machine learning model, etc. As an example, learning can include supervised learning (e.g., using labels, etc.) and/or unsupervised learning (e.g., not using labels, etc.). As an example, learning can include learning of one or more sets of tuning parameter values that may correspond to a mode or modes of operation.

As an example, the system 710 can be configured for one or more types of operations such as, for example, one or more of surface testing operations, cleanup operations, bleed-off operations, hydraulic fracturing operations, hydraulic fracturing plug drill out (FPDO) operations, hydraulic fracturing flowback operations, production operations, well intervention operations, production facility operations, etc.

As an example, the system 710 can be or become an autonomous surface system that is configured to self-adjust its parameters to maintain optimal process and operating conditions during performance of one or more operations.

As explained, the system 710 may be applied to well testing where a digital twin may be utilized. For example, the system 710 can include the DTM 390 of FIG. 3. The system 710 can provide for operational control via a method that includes acquiring data and, based at least in part on at least a portion of the acquired data being fed to a trained machine learning model, generating parameter values for optimum operating conditions as an output. In such an example, the parameter values can be utilized by one or more equipment controllers to adjust set points in an effort to achieve the optimal operating conditions.

As an example, the system 710 can include a diagnostic and insight component can include or be operatively coupled to a trained machine learning model (e.g., a digital twin, etc.) for purposes of outputting useful information and/or warnings. In such an example, the diagnostic and insight component can be capable of acting on its own and self-adjusting.

As an example, a system can include one or more trained machine learning models that can receive input and generate output for autonomous adjustment of a surface system. In such an example, a trained machine learning model can be trained in a manner to at least in part replicate knowledge of and operations performed by a surface crew (e.g., jobs or métier of a surface crew). As an example, such a system can allow for equipment such as a separator or choke to autonomously regulate and re-adjust its set points as a function of actual conditions, including flow conditions. As an example, such a system can be capable of regulating levels and pressures by automation and, for example, may go further by analyzing sensor data and then updating set points as conditions change. Such regulation can be performed at least in part in a manner akin to that of an experienced operational crew. Such an approach can be implemented via training that utilizes operational tasks performed by one or more crew members in response to acquisition of various types of sensor data. As mentioned, a DTM can be hardcoded using knowledge and expertise of such crew members and/or trained using a machine learning model. As mentioned, a tiered approach may be implemented that can transition from a hardcoded model to a trained machine learning model for purposes of enhanced automation.

As an example, a machine learning model can be a neural network model, which may be developed based on data from a sensors data database (e.g., operational data), which can include various crew actions (e.g., valves, operation, set point changes, pressure, temperature, flowrate changes, etc.). For example, a machine learning model can be trained and tested on such data. As explained, where a database is continuously increasing in volume of data, a model can be improved (e.g., additionally trained, retrained, etc.), which may provide the model with an ability to learn more complex patterns over time. One or more types of machine learning model or combinations of machine learning models may be considered for system control.

As to handcoded or hardcoded types of algorithms (e.g., models, etc.), a method can include accessing métier data, safety assessments and measures (HAZID, HAZOP, LOPA) and industry standards. As an example, from pFMEA and dFMEA, consequences, monitoring parameters, monitoring methods can be identified for appropriate and safe actions that may be implemented, for example, in the case that a machine learning model is not yet capable to provide a sufficient result.

Figure 8:
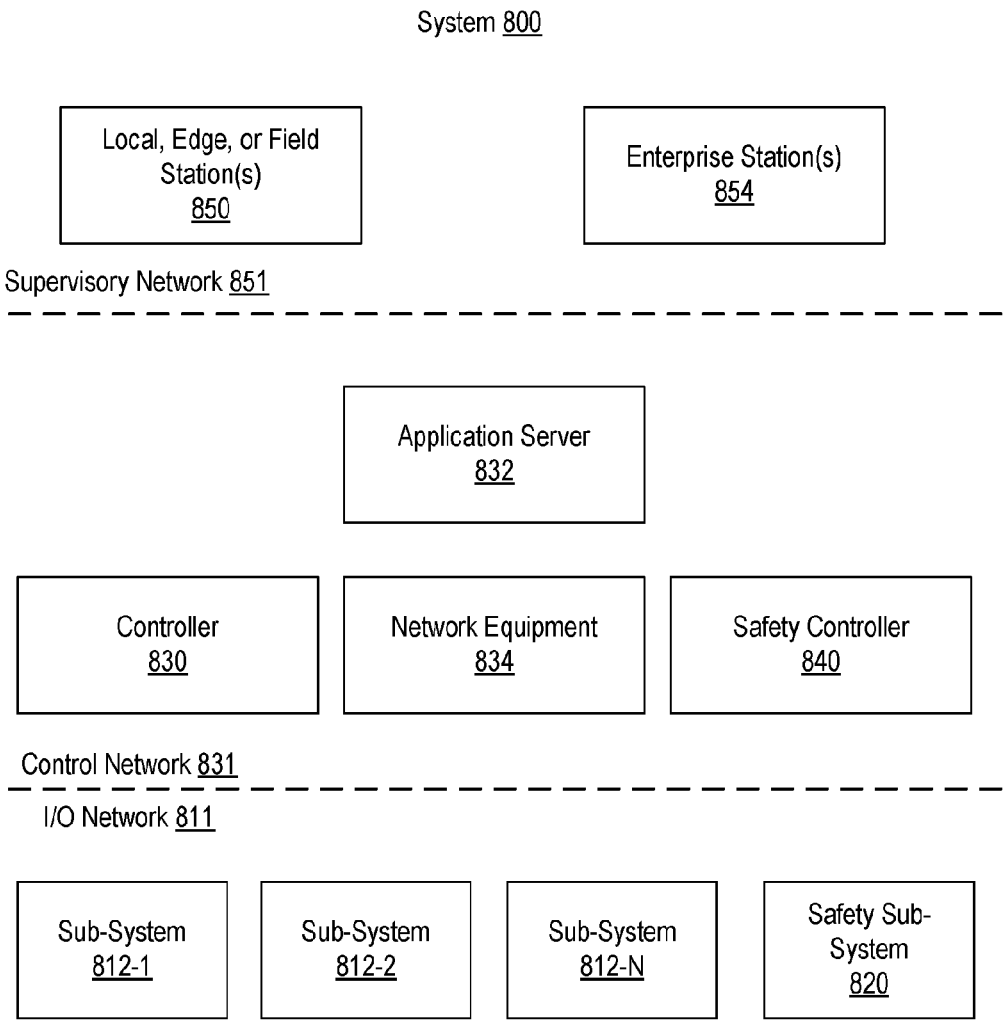
FIG. 8 is a diagram of an example of a system.

FIG. 8 shows an example of a system 800 that includes an I/O network layer 811, a control network layer 831, and a supervisory network layer 851. As shown, the I/O network layer 811 can include sub-systems 812-1, 812-2, to 812-N, and a safety sub-system 820 that include various components for acquiring data associated with a physical sub-system and operating the physical sub-system (e.g., control, etc.). The control network layer 831 can include a controller 830, an application server 832 (e.g., operating one or more DTMs and/or one or more other models), network equipment 834 for communications (e.g., transmissions, receptions, etc.), and a safety controller 840 (e.g., operatively coupled to at least the safety sub-system 820 of the I/O network layer 811, etc.). The supervisory network layer 851 can include one or more stations 850 (e.g., local station, edge station or field station) and one or more enterprise stations 854.

As an example, a station can be a workstation that is a computing device or a computing system. As an example, a station may be a mobile device, which may be carried by an individual, a vehicle, etc. As an example, a mobile device may be transportable from site to site, system-to-system, sub-system to sub-system, etc., for one or more purposes, which may include, for example, local data acquisition and/or control. For example, consider issuing an instruction via a graphical user interface rendered to a display of a mobile device that is transmitted and/or processed via the control network layer 831 and issued via the I/O network layer 811. In such an example, a response may be issued by equipment directly and/or indirectly to the mobile device. In a direct manner, consider a local area network (e.g., wireless), a proximity-based communication protocol (e.g., BLUETOOTH, etc.), etc.

As an example, the system 800 may provide for aggregation of interactions, communications, statuses, conditions, etc., for one or more systems. In such an example, the system 800 may be a source of information for training and/or retraining one or more machine learning models (e.g., one or more DTMs, etc.). As explained, a machine learning based approach can improve over time, which may improve as to one or more of prediction accuracy, ability to handle complexity, ability to increase complexity, etc.

In the system 800, the application server 832 can serve one or more DTMs that may be, for example, deployed via the controller 830, optionally in a manner that is sub-system-based. As shown, the safety controller 840 may operate with the safety sub-system 820, for example, via the network equipment 834 and/or via one or more alternative (e.g., redundant, etc.) communication channels.

In the system 800, data may be generated at the level of the I/O network layer at a rate of hundreds of data values per second, which may be routed via the network equipment. For a surface system set up for well testing, such data can include separator data, choke manifold data, downstream data, wellhead data, etc. As mentioned, a sensor may operate according to a sampling rate that is of the order of milliseconds (e.g., or microseconds, etc.). As an example, the controller 830 may operate using data samples at a rate of seconds, which may be a rate that intends to include data from a slowest responding sensor, etc., and/or to provide a time increment that can be relevant to phenomena that can occur in a surface system.

As to the one or more operator stations 850, they may be implemented using one or more resources (e.g., local, cloud, etc.). As to the one or more enterprise stations 854, they may be implemented using various resources that can provide for access to at least the control network layer 831. As an example, a supervisory level instruction can call for building of a DTM, deploying a DTM, implementing a DTM, etc. As an example, the application server 832 can provide for installing and/or instantiating a DTM at a wellsite using a supervisory controller system (e.g., SCADA, etc.) and/or a controller unit (e.g., PLC, etc.). As mentioned, a system can deploy multiple DTMs, which may be specialized as to various types of equipment in a surface system.

As mentioned, a DTM (see, e.g., the DTM 390, etc.) can be a model, which may be, for example, an algorithm (e.g., handcoded decision tree, etc.) or a trained machine learning model (trained ML model) that can be deployed to one or more controllers.

As to types of machine learning models, consider one or more of a support vector machine (SVM) model, a k-nearest neighbors (KNN) model, an ensemble classifier model, a neural network (NN) model, etc. As an example, a machine learning model can be a deep learning model (e.g., deep Boltzman machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model, may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

Figure 9:
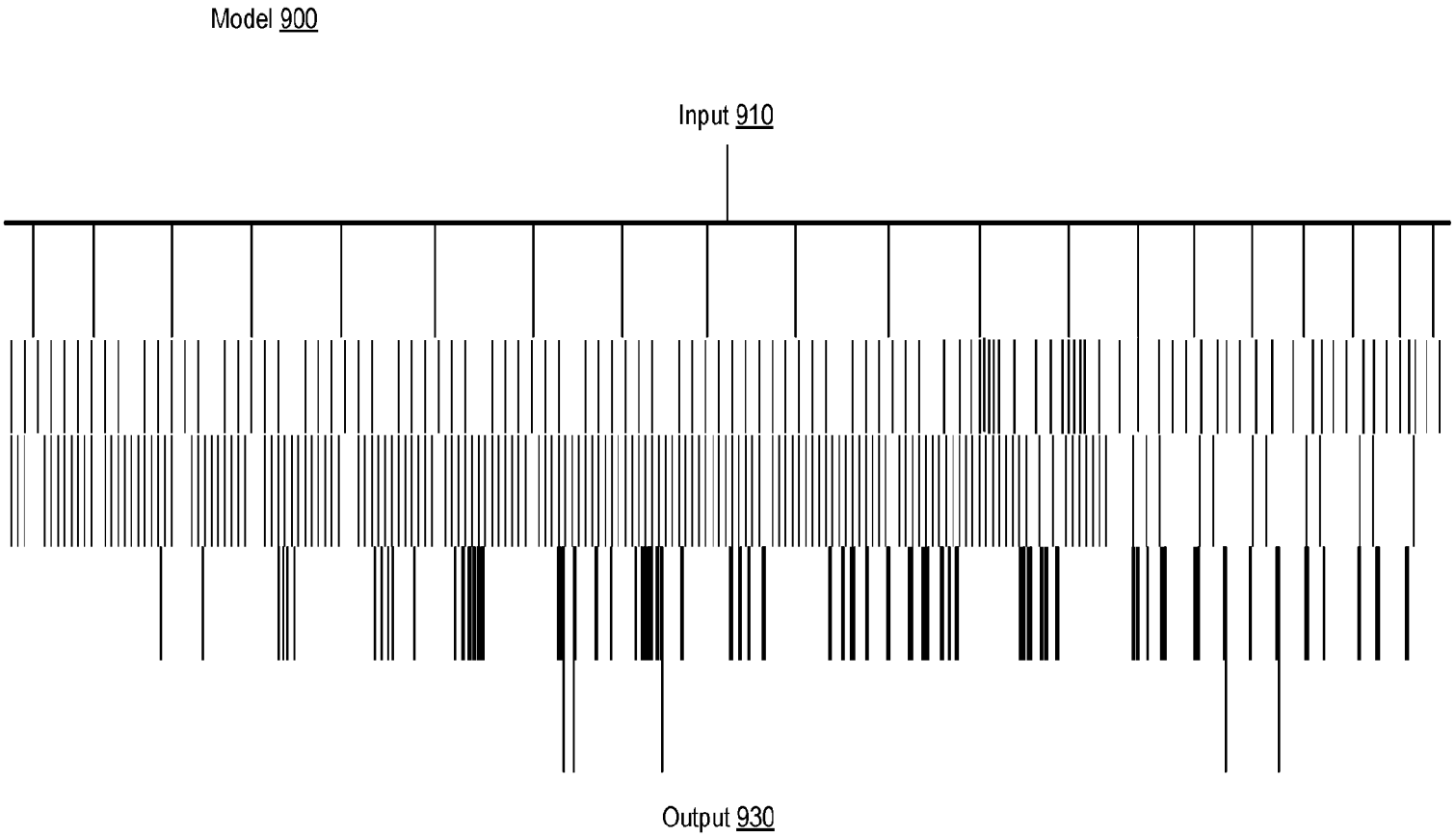
FIG. 9 is a diagram of an example of a model.

FIG. 9 shows an example of a model 900 that is a decision tree model. As shown, the model 900 includes input 910 and output 930. As an example, the model 900 can be a generative model of induction rules as derived from acquired data and operational performance by one or more operators. An optimal decision tree may be defined as a tree that accounts for most of the data, while minimizing the number of levels (e.g., questions). As an example, one or more techniques may be implemented to generate an optimal tree (e.g., ID3/4/5, CLS, ASSISTANT, CART, etc.).

Figure 10:
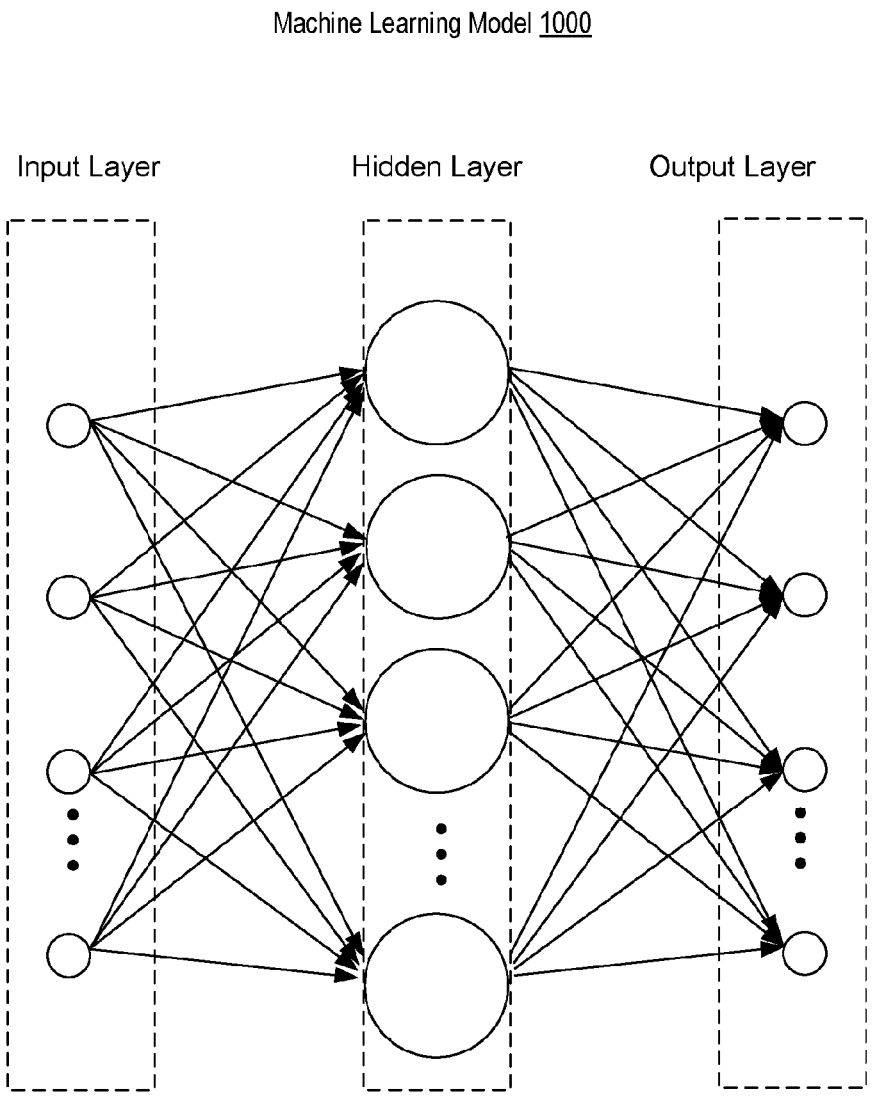
FIG. 10 is a diagram of an example of a machine learning model.

FIG. 10 shows an example of a machine learning model 1000 that can be a neural network (NN). As shown, the model 1000 can include an input layer, one or more hidden layers and an output layer. As an example, input can be received via the input layer to generate information in the hidden layer and to generate information in the output layer. As an example, information in at least one of a hidden layer and an output layer may be utilized for one or more purposes. As an example, an auto-encoder can provide for generating representations (embeddings) in a latent space where "latent" can refer to "hidden".

A NN can include neurons and connections where each connection provides the output of one neuron as an input to another neuron. Each connection can be assigned a weight that represents its relative importance. A given neuron can have multiple input and output connections. A NN can include a propagation function that computes the input to a neuron from outputs of its predecessor neurons and their connections as a weighted sum. As an example, a bias term can be added to the result of the propagation.

As an example, neurons can be organized into multiple layers, particularly in deep learning NNs. As explained, the layer that receives external data can be an input layer and the layer that produces a result or results can be an output layer. As an example, a NN may be fully connected where each neuron in one layer connects to each neuron in the next layer. As an example, a NN can utilize pooling, where a group of neurons in one layer connect to a single neuron in the next layer, thereby reducing the number of neurons in that layer. As an example, a NN can include connections that form a directed acyclic graph (DAG), which may define a feedforward networks. Alternatively, a NN can allow for connections between neurons in the same or previous layers (e.g., a recurrent network).

As an example, a NN may be a recurrent neural network (RNN), which is a class of artificial neural networks (ANNs) where connections between nodes can form a directed graph (DG) along a temporal sequence. A RNN can exhibit temporal dynamic behavior. In comparison to feedforward neural networks, a RNN can use its internal state (memory) to process variable length sequences of inputs.

As explained, one or more neural network models can be developed based on data (e.g., datasets, etc.) of one or more databases, live streams, etc., for sensors data (e.g., operational data) and associated types of crew actions (e.g., actions as to one or more of valves, operations, setpoint changes, pressures, temperatures, flowrate changes, etc.) where, for example, individuals performing such crew actions can include individuals that have been trained and tested (e.g., for system and/or one or more sub-system operations). In such an example, data can continuously grow where one or more of such models can be improved (e.g., trained, re-trained, etc.) such that, for example, more complex patterns can be learned over time. In such an example, more complex patterns may include patterns as to physical phenomena that may involve interactions between one or more sub-systems (e.g., complex interdependencies, etc.), for example, as to how such one or more sub-systems may be controlled.

As an example, a RNN may be characterized as a finite impulse model or as an infinite impulse model, either of which may exhibit temporal dynamic behavior. A finite impulse recurrent network can be a directed acyclic graph (DAG) that can be unrolled and replaced with a strictly feedforward neural network, while an infinite impulse recurrent network can be a directed cyclic graph (DAG) that cannot be unrolled.

A RNN, whether as a finite impulse or an infinite impulse recurrent network, can include additional stored states where storage can be under direct control by the RNN. As an example, storage can also be replaced by another network or graph (e.g., consider time delays, feedback loops, etc.). Such controlled states can be referred to as gated state or gated memory, and can be part of a long short-term memory (LSTM) approach, a gated recurrent units (GRUs) approach, etc. (e.g., consider a feedback neural network).

LSTM can be part of a deep learning system that can, for example, aim to address the vanishing gradient problem. LSTM may be augmented by recurrent gates (e.g., forget gates). LSTM can reduce risks of backpropagated errors from vanishing or exploding. For example, errors can flow backwards through a number of virtual layers unfolded in space. LSTM can learn tasks that demand memory of one or more events that happened a number of discrete time steps earlier. A LSTM approach can be employed with various types of timings, even given long delays between particular events. A LSTM approach may be employed where signals can include a range of frequencies (e.g., mixture of low and high frequency components, etc.).

As an example, a machine model may utilize stacks of LSTM RNNs, which may be, for example, trained via Connectionist Temporal Classification (CTC) to find an RNN weight matrix that maximizes the probability of the label sequences in a training set, given the corresponding input sequences. CTC may achieve both alignment and recognition.

As mentioned, a machine model can include one or more gated recurrent units (GRUs). A GRU can be a gating mechanism in a RNN. As an example, a GRU can be utilized in addition to or alternative to a LSTM; noting that a GRU approach may have fewer parameters than a LSTM approach, as a GRU can be without an output gate.

As an example, a machine learning model can be trained for handling data that can be synchronous and/or data that can be asynchronous. For example, a sub-system may operate in a manner that can generate data (e.g., sensor data, etc.) that are available according to a synchronous data transmission technique where, for example, the data are accompanied by timing signals (e.g., generated by an electronic clock) to ensure that the transmitter and the receiver are in step (synchronized) with one another. In such an example, data may be transmitted in blocks (e.g., frames or packets) spaced by fixed time intervals.

As mentioned, a machine learning model may be trained using training data from or derived from human operators, where such data may optionally include data from or derived from machine operators (e.g., automated controller, etc.). As an example, a method can include building a first model, operating equipment according to the first model, acquiring data and utilizing the data to train a second model. In such an example, a progression may exist from human control toward machine control. As to the first model, it may be built using data from various sources, which can include various operators. As operations progress, one or more other models (e.g., or the same model) may be trained using data from those progressed operations. In such an approach, human operator data may help to bootstrap development of an automated controller that is based at least in part on a machine learning model.

As to a machine learning model (ML model), as explained, such a model can be a neural network model (NN model). As an example, a trained ML model can be utilized to control one or more sub-systems. Various types of data may be acquired and optionally stored, which may provide for training one or more ML models and/or for offline analysis, etc. For example, air control parameters output by a trained NN model can be stored in digital storage for later analysis, which may include further training, training a different ML model, etc.

As an example, the TENSORFLOW framework (Google LLC, Mountain View, CA) may be implemented, which is an open source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations can be expressed as stateful dataflow graphs; noting that the name TENSORFLOW derives from the operations that such neural networks perform on multidimensional data arrays. Such arrays can be referred to as "tensors".

Various examples are described below that pertain to system and/or methods for autonomously adjusting one or more set points of one or more valves (e.g., choke valves, gate valves, etc.).

As an example, a system can automate flow control for the regulation of pressure or flowrate of hydrocarbon fluid passing through an adjustable automated choke. As an example, a method can include selecting a mode, switching, etc. As to switching, consider passing the flow from one side of a choke manifold to another side for one or more reasons, which may include one or more of passing from one fixed choke to another, checking the integrity of choke internals (e.g., erosion, damage, etc.), removing one or more obstructions due to solids, comparing between chokes (e.g., rates, pressure, sizes, etc.). As an example, a controller may aim to make changes that have reduced or minimal impact on one or more reservoir condition and/or reduced or minimal impact as to disturbance creation, which may impact downhole data, etc.

As to switching, it may be performed in a manual mode where an operator selects the valve to be operated one by one independently as may be performed physically on equipment or automated mode where, for example, a PLC may handle an operational sequence. As explained, such types of control can be additional to or alternative to individual choke control, which may be implemented using one or more modes (see, e.g., the system 1100 of FIG. 11 and the graphical user interface (GUI) 1500 of FIG. 15).

As an example, a mode may be a manual mode (e.g., an independent command mode) where a user may select one or more valves to be operated independently one after the other as may be performed as part of a testing process, etc. As an example, another mode may be an automated mode (e.g., sequential command mode) where a controller can control a valve sequence of a choke manifold from a valves sequence to follow, to the chokes operating mode as may be appropriate during a switch (e.g., if not in manual mode for the choke). As an example, a system may provide for toggling a switch button to launch a sequence after having provided the control mode for the choke that will now be active (e.g., manual or regulated).

As an example, equipment can be represented in a diagrammatic manner, for example, in a process flow diagram that can represent sensors and actuators involved in a system. Such a system can include one or more valves such as, for example, one or more gate valves, choke valves, etc., where one or more valves may be operatively coupled to a manifold and/or form a manifold such as, for example, a choke manifold valve control system. As an example, a system can include one or more actuators. For example, consider a system that includes a combination of choke valves and gate valves where each of the choke valves may be associated with a corresponding wellhead and where the gate valves can be downstream of the choke valves and/or between choke valves. As an example, a valve may be controllable via one or more actuators, which may include, for example, one or more electric motors. As an example, an actuator may provide for discrete on/off control and/or one or more other types of control (e.g., P, I, D, F, etc.).

As an example, one or more control systems may be suitable for integration into a higher-level automation system. In such an example, the higher-level automation system may include one or more separators and/or one or more other pieces of equipment.

As an example, a system may include various valves that allow for various configurations, for example, as to fluid communication between flowlines, etc. For example, consider a configuration with a well flowline that branches to opposing gate valves, each of which is in fluid communication with a respective choke valve. In such an example, each of the choke valves can be in fluid communication with another respective gate valve where those two gate valves can be controllably in fluid communication to provide fluid to a common flowline. Where the gate valves are numbered GV1, GV2, GV3 and GV4 and the choke valves CV1 and CV2, instrumentation may vary from one job to the other through control such as, for example, GV2 or GV4 actuated, CV1 or CV2 actuated, etc. (see, e.g., the example graphical user interface (GUI) 1600 of FIG. 16).

As an example, a system may provide for discovery of and/or provisioning of one or more sensors and/or actuators. As an example, one or more corresponding control routines may be enabled/disabled accordingly by execution of a control program. As an example, in an automatic switchover mode, when an actuator is not detected, a controller may request a manual confirmation of a valve position, etc. (e.g., via a GUI, etc.). As an example, a system may present a GUI that can indicate discovered and/or not discovered components (e.g., consider shaded rendering, full rendering, etc.).

As an example, a switch sequence can include opening downstream valves where, in case of manual valves, displaying a dialog box to request confirmation of valve open (e.g., "Please confirm downstream valves (GV 03 and 04) are in appropriate position!"). Such a sequence can then request choke opening and regulation mode for an idle side where, in case of manual choke, consider displaying a dialog box with a message (e.g., "Please confirm the idle choke (CK 01 or 02) is in the required position or size!"). As an example, the foregoing sequence can include bringing an idle side upstream valve to a start-to-open position and can include bringing an active upstream valve to ready-to-close position. As an example, the foregoing sequence can include putting active and idle chokes on manual mode where, for example, a next step is to start with minimal delay after putting the choke in manual mode. Such a sequence can include continuing opening of the idle upstream valve while at the same time closing the active upstream valve. Next, the sequence can include putting the newly active choke in the mode that was selected by the user before the switch and, for example, closing the newly idle downstream valve (e.g., optional). As an example, when switching between choke regulation modes, a system can include resetting a set point (SP) to the last process value acquired (PV) for the corresponding control mode. Such an approach can help to assure a smooth transition between operating modes and help to reduce abrupt changes in choke opening. As an example, a user may then slowly vary a SP to a desired value or, for example, a control scheme may be implemented for choke valve control.

As an example, in the foregoing scenario with choke valves and gate valves, a both sides open configuration may be implemented. For example, in the case both sides are active then one of the choke valves may be in a mode that can help to reduce risk of generating inference between the choke valves. For example, one or more choke valves may be in a manual mode or in a regulating mode. In such an example, if in a regulating mode, consider a position equal or greater than approximately 10 percent travel (e.g., or more, as appropriate) to remain within an operating range.

As an example, a configuration screen can include various graphical controls that can provide for input, output, etc. As an example, a GUI may provide for user activation of valves in manual and/or automated mode where, for example, in a manual mode, the number of turns selection may be presented along with an option for fully open or fully closed. As an example, a valve number of turns may be changeable to adapt to one or more of various makes of valves.

As mentioned, a system may be part of a larger system. For example, consider a choke valve system that can be part of a choke valve and gate valve system where either of such systems can be part of a larger system, which may be utilized for automated control of one or more operations, which can include one or more types of testing operations.

Various examples below describe a choke valve system where a choke valve can be automatically controlled in one or more control modes, which may include automated switching between multiple control modes. As an example, such a system may be implemented in combination with one or more other systems.

Some examples of systems and graphical user interfaces (GUIs) are shown in FIGS. 11, 12, 13, 14, 15 and 16. One or more features of the systems illustrated may be included in a system such as the system 110 of FIG. 1, the system 250 of FIG. 2, the system 300 of FIG. 3, etc.

Figure 11:
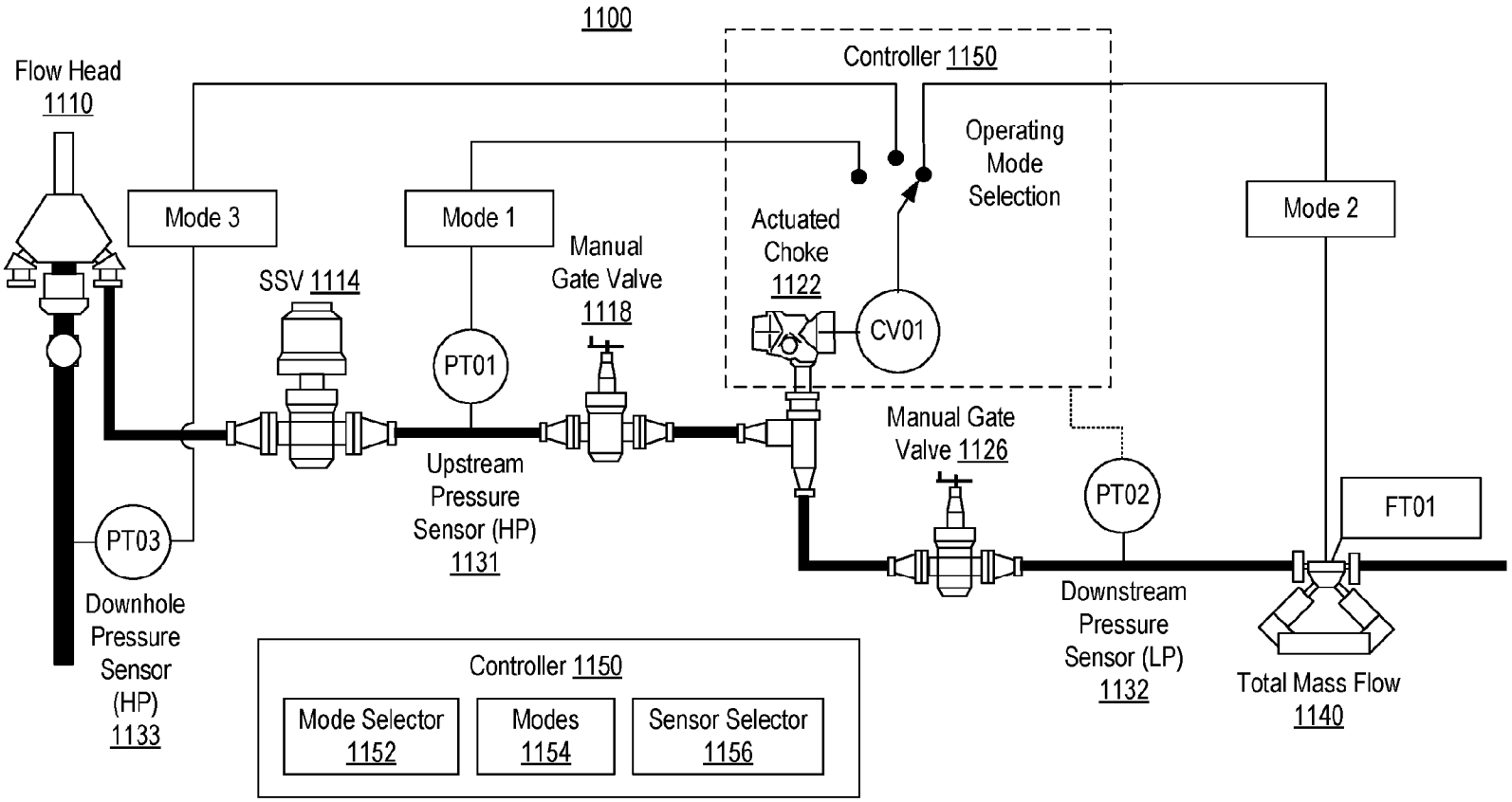
FIG. 11 is a diagram of an example of a system.

FIG. 11 shows an example of a system 1100 that includes a flow head 1110, a safety valve (SSV) 1114, a gate valve 1118, an actuated choke valve 1122, a gate valve 1126, an upstream pressure sensor unit 1131, a downstream pressure sensor unit 1132, a downhole pressure sensor unit 1133, a total mass sensor unit 1140 and a controller 1150.

While the actuated choke valve 1122 is illustrated in a particular system in FIG. 11, a controlled valve, such as, an autonomous choke valve, may be utilized in one or more other types of systems such as, for example, surface testing operations systems (e.g., clean up, bleed off, frac assist, frac plug drill out (FPDO), frac flowback, production, etc.), well intervention, production facilities, etc.

In the example of FIG. 11, the controller 1150 can provide for self-adjusting of the choke valve 1122, for example, by automatic setting in an effort to maintain optimal process operation (e.g., optimal operating conditions, etc.).

In the example of FIG. 11, the controller 1150 and the choke valve 1122 can be a sub-assembly that can control pressure and/or flowrate of hydrocarbon fluid passing through the choke valve 1122. For example, consider utilizing an assigned set point (SP) that the choke valve 1122 maintains through the controller 1150, which may be a proportional-integral-derivative (PID) controller. For example, the controller 1150 can include or be operatively coupled to an electric motor that can adjust the choke valve 112 (e.g., consider adjusting one or more openings in the choke valve 500 of FIG. 5). As an example, the controller 1150 can be operatively coupled to one or more other pieces of equipment, for example, for making one or adjustments to an operation, etc.

As shown in the example of FIG. 11, the controller 1150 can include and/or be operatively coupled to a mode selector 1152 that provides for selection of one or more modes 1154 (e.g., from a group of modes that can include at least two of Mode 1, Mode 2 and Mode 3). As shown, the controller 1150 may include a sensor selector 1156 that can provide for selection of one or more sensors for receipt of sensor data (e.g., consider one or more of the sensors 1131, 1132, 1133 and 1140, etc.). For example, a mode may provide for operation using one or more sensors. As an example, a set of tuning parameter values may provide for control using one or more sensors. For example, a set of tuning parameter values may provide for control using sensor data from multiple sensors. As to the mode selector 1152 and the sensor selector 1156, such selectors may be available via one or more user interfaces (e.g., graphical user interfaces, physical interfaces, etc.). As shown in the example of FIG. 11, various equipment may include features for manual adjustment (e.g., consider the manual gate valve 1126, etc.). As an example, the controller 1150 may include one or more user interfaces available on-site for input, interaction, etc. via one or more of a device and a human hand.

A controller may be represented using one or more models, one or more equations, etc. For example, output of a PID controller may be represented as follows in the time domain:

$$u(t) = K_p e(t) + K_i \int e(t)dt + K_d \frac{de}{dt}$$

In the foregoing equation, the variable e represents the tracking error, the difference between the desired output r and the actual output y. This error signal can be fed to a PID controller, and the controller can compute the derivative and the integral of this error signal with respect to time. The control signal u to the plant is equal to the proportional gain $K_p$ times the magnitude of the error plus the integral gain $K_i$ times the integral of the error plus the derivative gain $K_d$ times the derivative of the error. In the foregoing equation, the control signal u can be fed to the plant and the new output y obtained where the new output y is then fed back and compared to the reference to find the new error signal e. The controller can then utilize the new error signal and computes an update of the control input.

A transfer function of a PID controller may be determined by taking the Laplace transform of the foregoing equation, where the transfer function can be represented as follows:

$$K_p + \frac{K_i}{s} + K_d s = \frac{K_d s^2 + K_p s + K_i}{s}$$

As an example, where a PIDF controller is employed, the transfer function can include an additional parameter known as a filter time, $T_f$. For example, consider the following transfer function:

$$K_p + \frac{K_i}{s} + \frac{K_d s}{(1 + T_f s)}$$

In such an example, the filter is associated with the derivative part, noting that a filter may be associated with another part such as the proportional part. As an example, one or more types of tunable controllers may be utilized for controlling a system such as, for example, controlling a choke valve of a system. As to tuning, one or more techniques may be employed, which can include modeling, trials, data analysis, etc. As an example, one or more machine learning models may be utilized for tuning a controller to provide one or more tunable parameter values, which may pertain to particular types of modes of operation, conditions, etc.

As an example, where data are available, a machine learning may be trained to provide for one or more tuning parameter values for given input. In such an example, a system may be tuned using a trained machine learning model.

As an example, a process variable (PV) can be a pressure like on a standard control valve and/or one or more other types of data that can be "regulated on" (e.g., like flowrate(s), performance index, Cv, etc.).

As an example, the choke valve 1122 may be regulated locally, at an edge, remotely, etc., where manual override may be available.

As an example, a system can include a controlled choke valve (e.g., P, I, D, F, PI, PID, PIDF, etc.) that can operate according to one or more algorithms, one or more machine learning models (e.g., neural network, etc.), etc. As an example, such a system can include various types of equipment. For example, consider sensors, actuators, controllers, data acquisition units, fluid separators, choke manifolds, PLC units, SCADA units, etc.

As an example, a method can provide for autonomous adjustment of a choke valve through one or more of various controllers and algorithms. In such an example, various techniques can provide for automation of operations more effectively than manual procedures.

As an example, during surface testing operations, a choke valve can be used to maintain a flowrate or maintain a pressure upstream of the choke valve. As an example, a set point approach (e.g., flowrate or pressure) may be utilized as a target that is to be maintained via opening or closing a choke valve and observing the resulting effect.

In various instances, control can demand fast regulation against the set point while, in other instances, control can demand slower regulation where the effect of a change of choke valve opening size may not be reflected immediately in a fluid system. For example, in a flow network, interdependencies can exist that may take some considerable amount of time to reach a steady state after an adjustment to a choke valve.

As an example, slow adjustment of a choke valve change can be utilized for regulating a return rate in an annulus while pumping through tubing (e.g., large volume depressurization) or when regulating on acquired data that might not be transmitted rapidly (e.g., consider data delays on the order of 30 seconds or more).

A controller can include various tunable parameters that can be set to parameter values to tune the controller (e.g., a tuned controller). For example, a PID controller can include various tunable parameters that provide for proportional, integral and derivative control. In such an example, the tunable parameters can depend on system dynamics such that slow system dynamics have different parameter values (different tuning) than fast system dynamics. As an example, a control system can include different PID tunable parameters and/or parameter values for desired types of regulation, which can depend on operation type.

As an example, a fast regulation scheme can be based on upstream pressure regulation for surface flow or pumping, flowrate regulation, etc. As an example, a slow regulation scheme can be based on downhole pressure, production index, rate of return (e.g., coil tubing, well circulation, etc.), etc.

FIG. 11 shows some examples of modes of operation, including mode 1, mode 2 and mode 3. As shown, mode 1 is an upstream pressure regulation mode where upstream pressure is regulated, for example, in an effort to maintain upstream pressure at given value, which can be measured via the upstream pressure sensor 1131 (e.g., a pressure that is upstream the choke valve 1122). As an example, the upstream pressure value can be assigned a set point. In such an example, sensors that can be monitored include the upstream pressure sensor 1131 to acquire the incoming pressure to the choke valve 1122 and the downstream pressure sensor 1132 to acquire the outgoing pressure of the choke valve 1122. In this case, the process variable (PV) will be the upstream pressure as an outcome of the control loop, the optimized choke valve opening coefficient is obtained. As to mode 2, it provides for flowrate regulation, which is a mode that can control the total flow rate produced through the choke valve. For example, consider control that aims to keep a desired downstream flowrate while ensuring that the downstream pressure does not exceed the downstream equipment pressure rating. Such a control scheme can be provided as a safety feature that aims to ensure equipment integrity (e.g., in accordance with a manufacturer rated value such as an equipment pressure rating, etc.). As an example, the total flowrate value can be assigned as a set point where feedback can be obtained through a HELIOS system approach as a calculated total mass rate derived from one or more other parameters/measurements and/or directly from a single-phase flow meter or flow meters, which may be installed downstream from a separator. In the example of FIG. 11, the total flow mass sensor 1140 may be utilized for mode 2 operation. In this case, the process variable (PV) will be the total mass flow. As an outcome of the control loop, the optimized choke valve opening coefficient is obtained.

As to mode 3, it provides for downhole pressure regulation, which is a mode that can have some similarities to mode 1 but with consideration of downhole pressure rather than the surface upstream pressure in order to follow an inflow performance relationship (IPR) value or a specific downhole pressure during operation. As an example, the downhole pressure value can be assigned as a set point. As to downhole pressure regulation, complexity can arise from what may be limited access to a downhole pressure gauge and its readings, which may be downhole at some distance. Thus, the data rate could be slower than needed and will require flexibility from the control loop to address all cases. In this case, the process variable (PV) will be the downhole pressure. As an outcome of the control loop, the optimized choke valve opening coefficient is obtained.

As an example, where an artificial lift technology is utilized, one or more measures as to the artificial lift technology may be utilized. For example, consider an electric submersible pump power input, speed, temperature, pressure(s), flow rate, etc. For example, an electric submersible pump assembly can include a downhole gauge and a surface power supply where measures from one or both may be utilized in a control scheme (e.g., for information as to one or more conditions that are germane to control of a valve or valves, etc.).

As to IPR, it can be part of a computational tool used in production engineering to assess well performance that can include plotting well production rate against flowing bottomhole pressure (BHP). Data underlying IPR values may be obtained by measuring production rates under various drawdown pressures where reservoir fluid composition and behavior of fluid phases under flowing conditions can determine curve shape.

As shown in FIG. 11, the controller 1150 can provide for mode selection such that the controller 1150 can control the choke valve 1122 according to a selected one of the various modes. In the example shown, mode 2 is selected such that information from the total mass flow sensor 1140 can be utilized for adjusting the choke valve 1122 (e.g., a mode 2 control loop). As explained, the controller 1150 may be utilized for different process variables in different control loops, for example, depending on the operating mode selected.

Table 1, below, lists various examples of operating modes, process variables and manipulated variables.

TABLE 1

| Operating Mode | Process Variable | Manipulated Variable |
|---|---|---|
| 1 - Upstream Pressure Regulation | PT01 - Upstream Pressure | CV % Choke Valve opening coefficient |
| 2 - Flowrate Regulation | FT01 - Total Mass Flow | CV % Choke Valve opening coefficient |
| 3 - Downhole Pressure Regulation | PT03 - Downhole Pressure | CV % Choke Valve opening coefficient |

Table 2, below, lists various examples of tags (shown in FIG. 11), signals, units, ranges, and rates.

TABLE 2

| Tag | Signal | Unit | Range | Rate |
|---|---|---|---|---|
| CV01 | Choke opening | % | [0-100] | 10 Hz |
| PT01 | Upstream pressure | psi | [0-100000] | 10 Hz |
| PT02 | Downstream pressure | psi | [0-100000] | 10 Hz |
| PT03 | Downhole pressure | psi | [0-150000] | 30 s |
| FT01 | Total (or single-phase) mass flow | kg/s | [0-100] | 1 Hz |
| FT01 | Total (or single-phase) mass flow | kg/s | [0-100] | 10 Hz |

The three modes that have been described above and associated process variables (PVs) are provided as some examples as one or more other modes may be used for regulating the choke valve. For instance, other models may include regulating the choke valve based on a process variable (PV) such as production index (PI), rate of return (RoR), etc.

As to the choke opening, a valve command signal may be transmitted over a loop (e.g., 4-20 mA HART loop) where the following dynamic variables may be retrieved via a protocol for diagnostic purposes: Demand (%); Position (%); and Torque (%). An electric actuator may then be used to modify the choke opening based on the valve command signals.

As to the downhole pressure, a communication watchdog may be implemented to help maintain a live communication link.

As to the total mass flow, as an example, one or more techniques may be utilized, for example, consider the HELIOS system, which may provide a more accurate value than a directly computed value of the PLC system as the sum of the single-phase mass rates (typically oil, water, gas) measured by a Coriolis flow meter(s) downstream a separator, which may provide a higher sampling rate.

As an example, a system can include one or more maximum allowed values for given parameters such as a process variable (PV), which may be specified for standard operation and/or special operation, one or more set point values for one or more parameters, one or more threshold deviation tolerances from a set point value, one or more alarms (e.g., when a threshold is breached, etc.). The system may for instance include a low regulation band that defines stable operations (e.g., +/−2.5 percent from a set point value for the PV, etc.), a high regulation band that defines less stable and/or unstable operations (e.g., +/−10 percent from a set point value for the PV), a safe working band (e.g., maximum allowable working pressure of equipment where control shutdown may be triggered when a process variable goes beyond this band), one or more IPRs (e.g., curves used to assess well performance via plots of flowing bottomhole pressure (BHP) versus well production rate), one or more bottomhole pressures, as measured and/or as computed (e.g., pressure expected to occur at a datum level rather than actual depth of a pressure gauge, etc.).

As an example, a system can provide for automating the regulation of hydrocarbon pressure and/or flowrate with an adjustable choke valve or valves. In such an example, the system can operate in one or more choke valve control loops to automate regulation of hydrocarbon fluid pressure and/or flowrate (e.g., optionally in a single choke valve set-up). For example, consider a loop that can control the pinch point between high pressure (HP) upstream services and low pressure (LP) downstream services, adapting hydrocarbon feed so as not to damage the downstream equipment.

As an example, a system may be tailored for testing services such as, for example, testing service land facilities where automation can supplement or substitute for manual choke valve operation.

A system may automate the regulation of pressure and/or flowrate of hydrocarbon fluid passing through an adjustable automated choke, for example, by building a controller that can provide for one or more of P, I, D and F types of control. In such an example, a set point (SP) can be assigned (e.g., via machine, human, etc.). A controller can generate output that can control opening and closing of an electrically actuated choke valve. In such an example, the controller can select one or more of different inputs, tunings, etc. For example, consider selection amongst different existing pressure instrumentation and flowrate instrumentation as may be located upstream or downstream of choke valve to provide measured process variables (PV) that can depend on a mode of operation selected, thus closing a feedback loop.

As explained, a system can operate using one or more of different modes of operation. Such a system may be implemented using one or more choke valves at one or more sites, which may be sites for one or more wells that are in fluid communication with a reservoir (e.g., a common reservoir) or reservoirs (e.g., multiple reservoirs).

As explained, a mode can be associated with a controller operational scheme, which can involve one or more types of control (e.g., P, I, D, F, etc.) that can include particular tunings that can depend on dynamics (e.g., slow, fast, etc.). A mode can also be associated with one or more types of input. As mentioned, an input may be a downhole input, an upstream input or a downstream input. Where fluid is being produced by a well, a downhole input can be a type of upstream input that is upstream from a choke valve. Where fluid is being injected via a well, a downhole input may be a type of downstream input that is downstream from a choke valve.

As explained, tuning of a controller in a control loop can differ based on the operation being conducted. For example, some operations, like a "clean up phase" can involve a fast control loop while others, like a "post frac" and IPR, can involve a slow control loop (e.g., slower than for a clean up phase, etc.).

Where a controller can operate in multiple modes, such modes can include one or more of an upstream pressure regulation mode, a flow regulation mode and a downhole pressure regulation mode. In the upstream pressure regulation mode, sensors monitored can include an upstream pressure sensor to acquire the incoming pressure and a downstream pressure sensor to acquire the outgoing pressure. In the flowrate regulation mode, HELIOS equipment and/or other equipment may provide a total mass rate value (e.g., calculated total mass rate or directly from a single-phase flow meter, etc.). In the downhole pressure regulation mode, a data rate may be relatively slow such that control demands flexibility to address various conditions.

As an example, a system can include PLC program(s) for multiple CPUs (e.g., DRUM, DACM, etc.), HMI views deployed on a desktop or tablet computing system, a graphical guide for start-up, conditions, etc.

In the example of FIG. 11, the system 1100 can include one or more other types of sensors, such as temperature, density meter, etc. Such additional measurements may be used to infer process diagnostics such as hydrates detection and predict operational events.

As an example, an electric actuator may be utilized to adjust a choke valve opening.

As to acquisition and control equipment, consider, for example, a standalone acquisition and control module or a co-allocated in a separator acquisition and control module, along with separator pressure and level control loops. A controller may provide for execution of logic using several control modules.

Some of signals involved in a control loop may be directly acquired through analog or digital input modules or, for example, fetched over a local area network (LAN) on which the controller is connected (e.g., along with HELIOS and/or other equipment).

Figure 12:
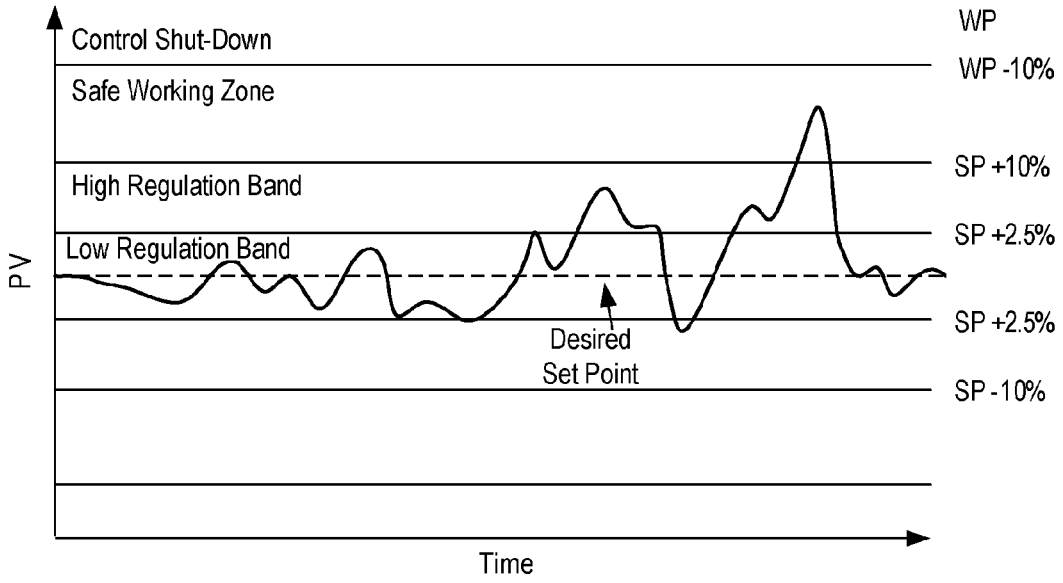
FIG. 12 is a diagram of an example of a control graphical user interface and an example of a table of values.

FIG. 12 shows an example plot 1210 and an example table 1230 with respect to regulation within different bands as shown in the plot 1210 as may be defined by data in the table 1230.

The bands can correspond to operational ranges where, for example, a low regulation band pertains to smooth regulation where a process is not undergoing an upset; a high regulation band where a process experiences an upset and is trying to recover (e.g., a choke valve or separator level change); and a safe working zone where a process value (PV) is to operate within a minimum and a maximum working pressure of the equipment (e.g., otherwise disabling an automatic control loop, etc.).

The table 1230 can include one or more default thresholds for each process variable where a graphical user interface (GUI) and/or other feature may allow for adjustment (e.g., editable by a user from a configuration panel, etc.).

Figure 13:
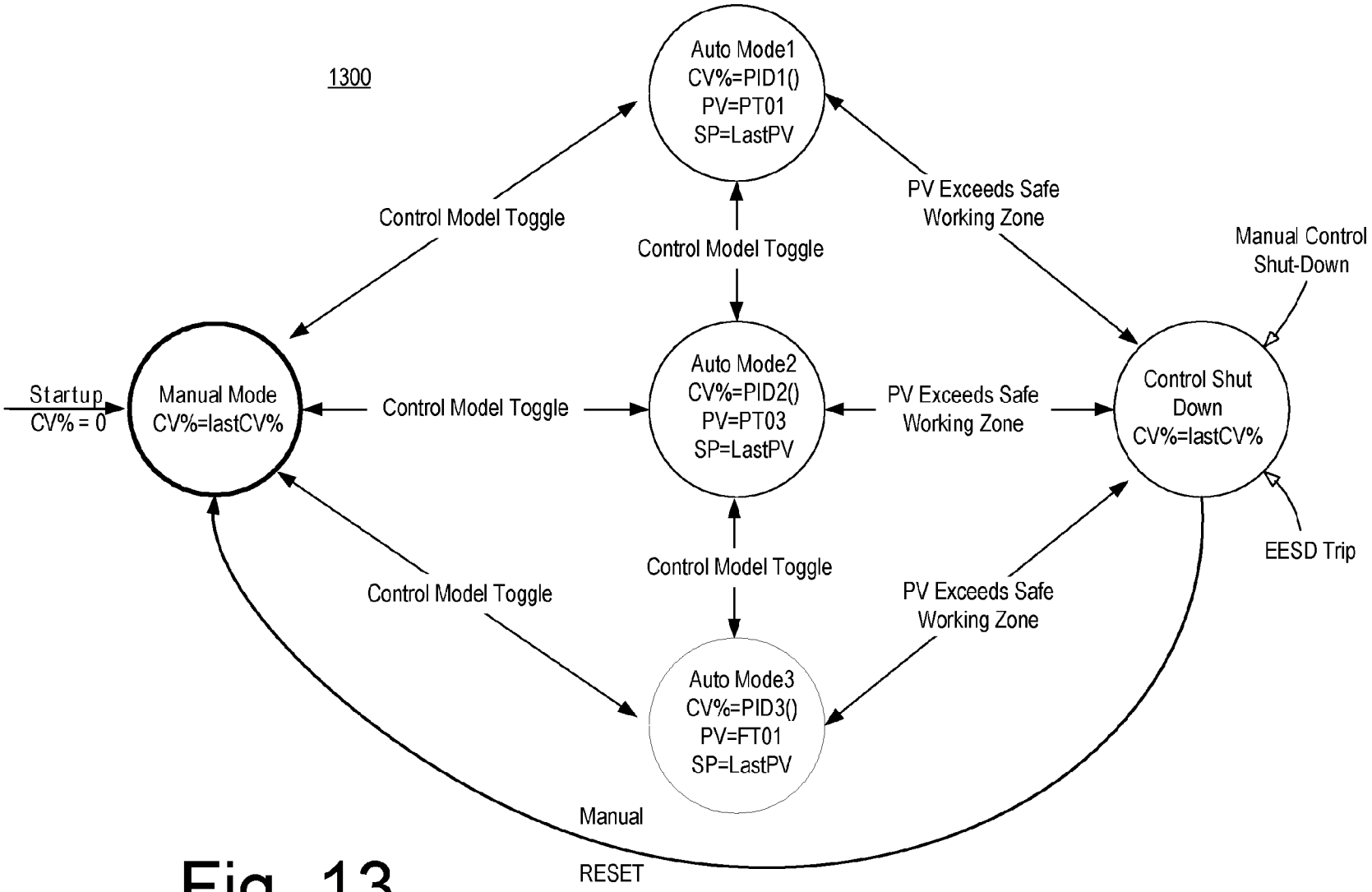
FIG. 13 is a diagram of an example of a state diagram that includes state transitions and sequences.

FIG. 13 shows an example of a state diagram 1300 for control operations, including operational sequences. For example, at start-up, a system can start in a manual mode where an opening coefficient of a choke valve (CV %) is initialized at 0, which may be manually incremented by a user and where a user can also decide to switch to a selected automatic modes (e.g., AUTO MODE 1, AUTO MODE 2 and AUTO MODE 3) which will activate the respective controller (e.g., P, I, D, F, etc.).

As indicated, when switching between modes, the system can reset a set point (SP) to a last process value acquired (PV) for the corresponding control mode, which can help to ensure a smooth transition between operating modes and reduce risk of abrupt changes in a choke opening. In such an example, a user may then slowly vary the SP to a desired value.

When a process variable corresponding to an automatic mode selected (PT-01 for Mode 1, FT-01 for Mode 2, PT-03 for mode 3) exceeds its safe working zone, in the event of a manual emergency stop from a user or in case of an EESD trip, the system can enters the CONTROL SHUT-DOWN state. In such an example, the valve command can be set to the last opening coefficient, similarly to a "fail-as-is" mechanism. In such an example, a user can manually acknowledge and reset the system before switching back to the MANUAL mode.

As to P, I and D types of control (e.g., PID), consider bump-less initialization where an initial integral accumulator term is calculated so as to maintain a consistent process output when switching between operating modes or when changing one or more PID parameters; output saturation where PID output (e.g., CV %) can be limited to a safe operating range of a choke valve (e.g., consider from 20 percent to 100 percent); anti wind-up control that can be implemented to discharge the integral accumulator term when the controller hits a saturation limit and enters non-linear operation; a set point ramping feature that provides an effective set point value smoothed slowly towards a final target value (e.g., based on a defined ramp-rate, etc.); set point clamping where effective variation of a set point value is limited to a defined interval (e.g., to help reduce risk of abrupt changes of choke opening); autotuning where an autotuning process can be implemented to help identify a first set of parameters for each automatic control mode (e.g., consider such a feature providing for temporarily opening a control loop, performing incremental changes in valve opening to thereby estimate a system transfer function); and safeguards that can limit a choke opening (CV %) and/or process value (PV) variations.

As to an example of Mode 1—Upstream Pressure Regulation:

- The PV is obtained from the upstream Pressure sensor PT-01
- Behaves as a direct acting PID loop (e.g., or PI loop, etc.):
  - When Higher than set point: Open choke valve to decrease pressure
  - When Lower than set point: Close choke valve to increase pressure
- Loop update time: 500 ms As to an example of Mode 2—Flowrate Regulation

- The PV is obtained from the downstream flow meter FT-01
- Behaves as a reverse acting PID loop (e.g., or PI loop, etc.):
  - When Higher than set point: Reduce choke valve to decrease flow
  - When Lower than set point: Increase choke valve to increase flow
- Loop update time: 500 ms As to an example of Mode 3—Downhole Pressure Regulation

- The PV is obtained from the downhole pressure sensor PT-03
- Behaves as a direct acting PID loop (e.g., or PI loop, etc.):
  - When Higher than set point: Open choke valve to decrease pressure
  - When Lower than set point: Close choke valve to increase pressure
- Loop update time: 30 sec (to account for the downhole volume and compressibility factors)

As an example, tuned coefficients may be for single-phase fluids and may differ for multi-phase fluids (e.g., multi-phase mixtures, etc.).

Figure 14:
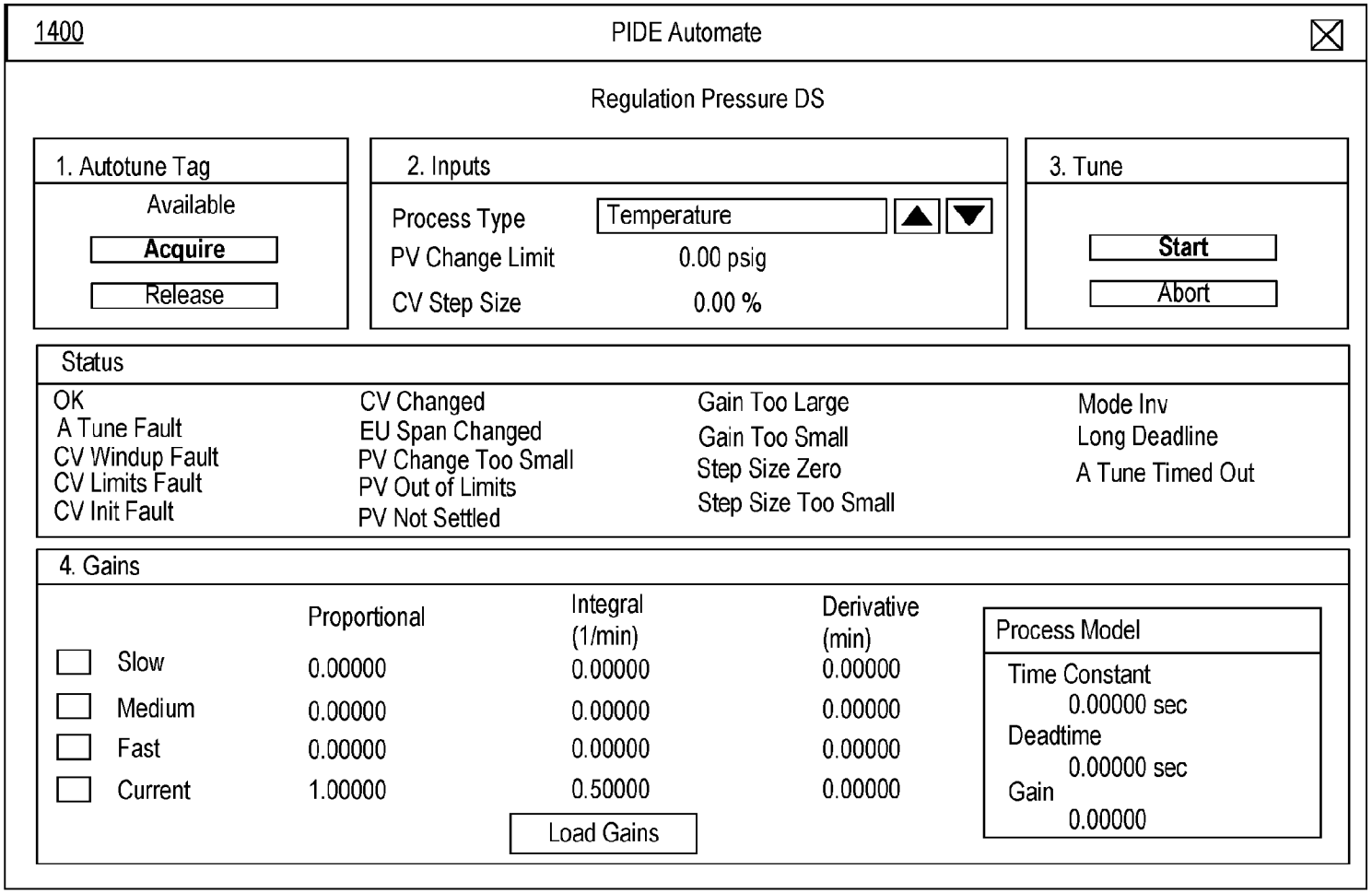
FIG. 14 is a diagram of an example of a graphical user interface.

FIG. 14 shows an example of a graphical user interface (GUI) 1400 that can provide various features including, for example, features for configuration, control/monitoring and alarms management.

As to a configuration screen, it can allow for update various settings, which may be according to access rights:

- FT-01 total mass flow rate estimation
  - Option 1: read from HELIOS
  - Option 2: estimated from single-phase Coriolis flow meters
- P, I, and/or D, etc., settings for each control mode
  - Gains (e.g., one or more of $K_p$, $K_i$, $K_d$, etc.)
  - Loop update times
  - Output saturation upper and lower limits
  - Set point ramp rate
  - Set-point clamping values
- Operating ranges limits for each process variable:
  - Low regulation band threshold
  - High regulation band threshold
  - Upper and lower limits for the safe working zone As an example, a GUI can provide for loading of predefined operating profiles, for example, corresponding to various phases of well-testing operations (e.g., operational modes, etc.). For example, when a given profile is selected, the system will update the controller settings and operating range limits accordingly. Example profiles can include:

- Profile 1: cushion off-loading
- Profile 2: gas at surface
- Profile 3: clean-up
- Profile 4: well re-opening
- Profile 5: main flow As an example, a GUI can allow a user to launch an auto-tuning menu.

Figure 15:
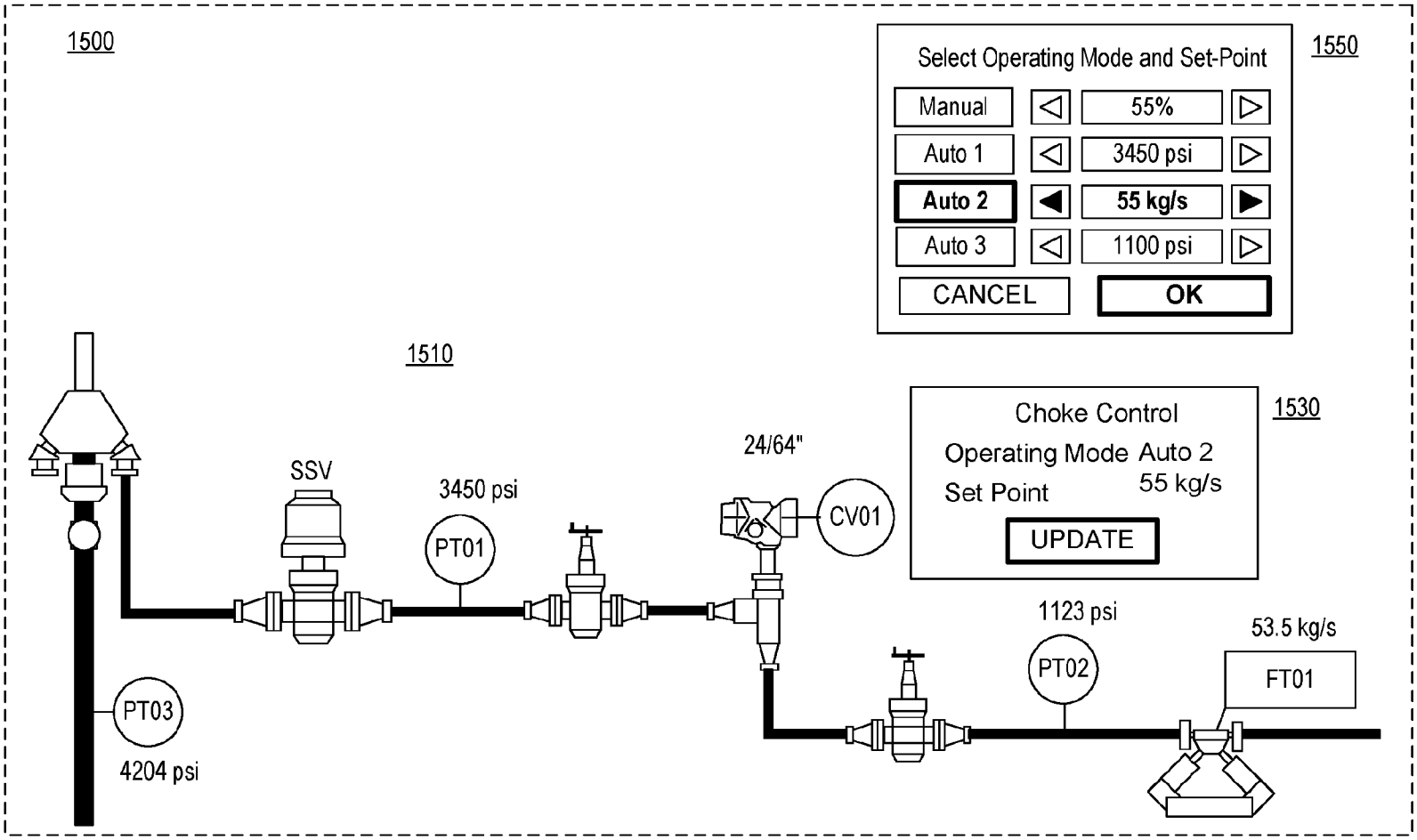
FIG. 15 is a diagram of an example of a graphical user interface.

FIG. 15 shows an example of a GUI 1500 that includes graphics 1510, 1530 and 1550, which may be interactive and include one or more graphical controls. As to a process view, consider features such as an overview of a process state by observing real-time sensor values on a process flow diagram; a toggle control that can toggle between various modes (e.g., Manual, Auto mode 1, Auto mode 2, Auto mode 3) where a corresponding process variable can be highlighted to allow a user to quickly identify a value of interest (see, e.g., "Auto 2" and "55 kg/s" as a mass flow rate); a set point adjust and/or a valve command through a pop-up graphic, etc.; when switching to a new operating mode, a last value of the corresponding PV can be written into a set point edit box where a user may then decide to change it and click on "OK", provided that the SP is within a clamping interval and where a set-point value may be coerced to an upper or a lower limit otherwise; etc.

In the example of FIG. 15, the graphics 1550 can be for a GUI that allows for selection of an operating mode that can be accompanied by a set of tuning parameter values. For example, consider a touch-screen that a user may touch to select a mode and/or a set point. As an example, the graphics 1550 can be part of a selector that provides for issuance of a selection signal that instructs a loader to load a set of tuning parameter values and, for example, to select one or more sensors for receipt of sensor data. In such an example, the loader can access memory where sets of tuning parameter values are stored, optionally along with information pertaining to appropriate or selected sensor configurations.

As an example, a GUI can include an alarms panel where various warnings and alarms that can be raised during the automatic operation of the choke may be summarized, acknowledged and reset from a dedicated alarm list or an alarm banner.

Figure 16:
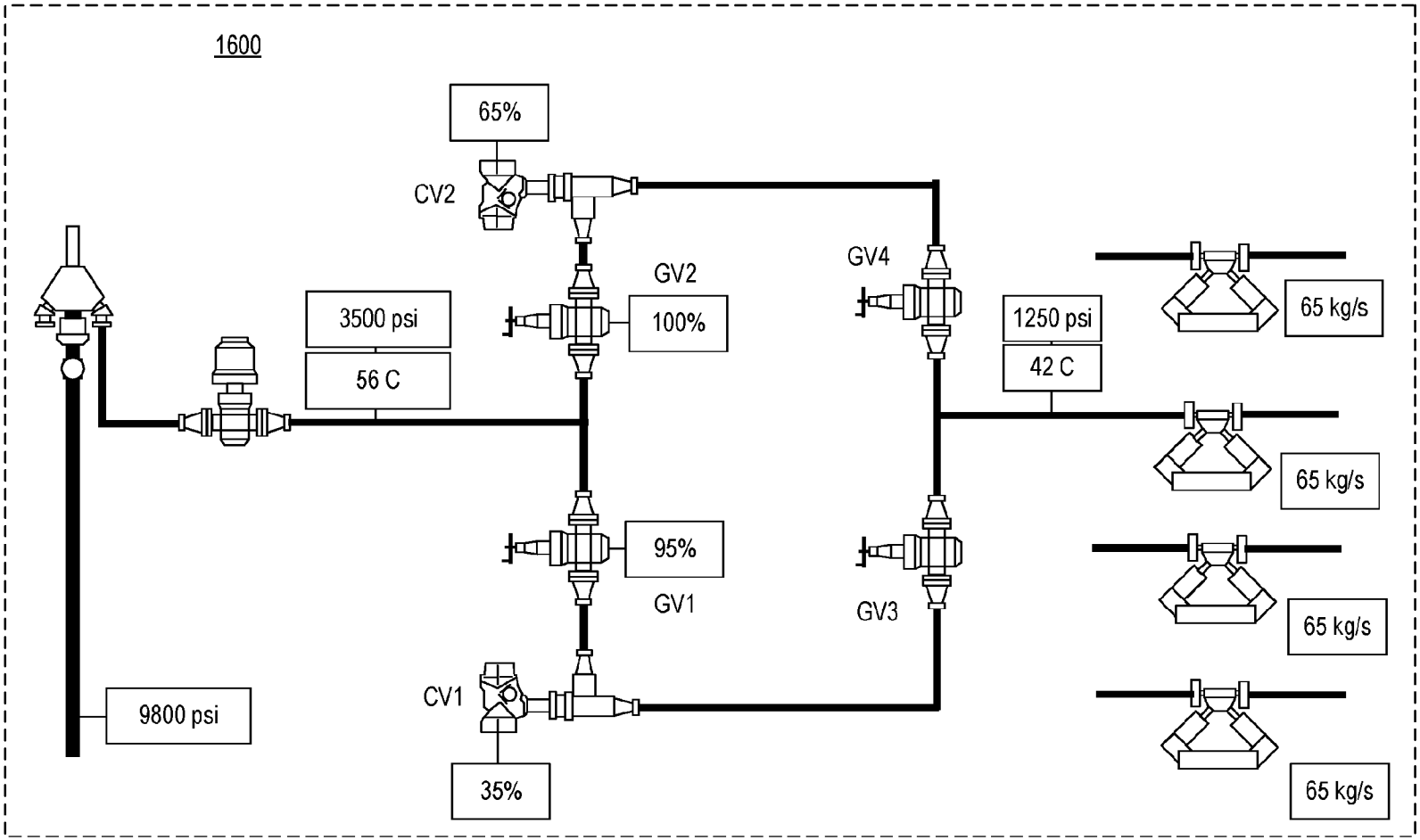
FIG. 16 is a diagram of an example of a graphical user interface.

FIG. 16 shows an example of a graphical user interface (GUI) 1600 that includes various choke valves (e.g., CV1 and CV2) and various gate valves (e.g., GV1, GV2, GV3 and GV4). In such an example, one or more graphical controls can allow for interactions, which may be for presentation of measurements, control parameters, control actions, etc. As an example, such a GUI may allow for execution of one or more methods, sequences, modes, etc., of operation of field equipment (e.g., for testing, etc.).

As mentioned, a controller may be utilized for controlling one or more aspects of an artificial lift operation or operations at one or more wells. For example, consider control of one or more valves for lift gas, one or more valves that can control flow driven by one or more ESPs, etc. As an example, a P, I, D, and/or F type of control scheme may be utilized in an artificial lift scenario, etc.

Figure 17:
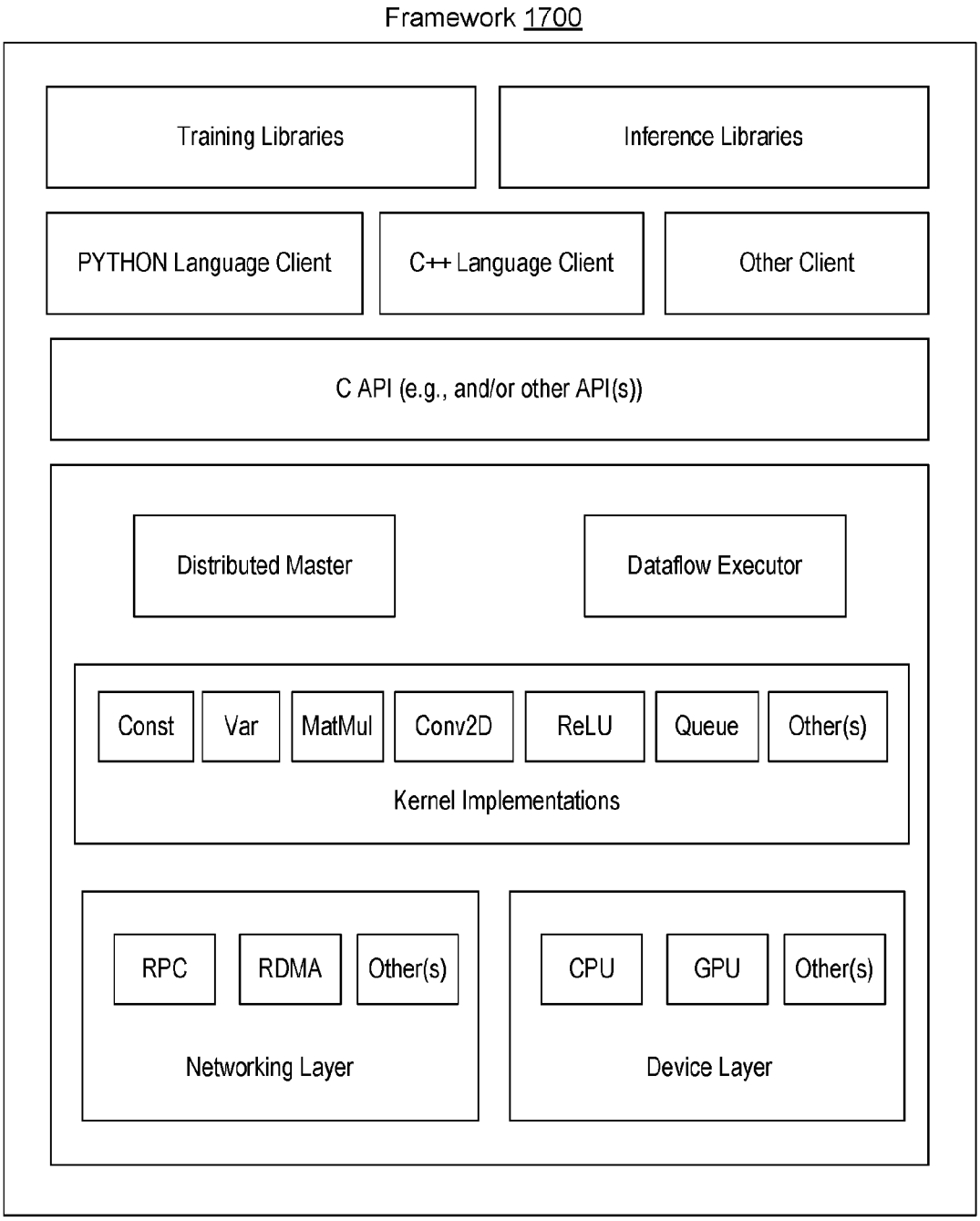
FIG. 17 is a diagram of an example of a computational framework.

FIG. 17 shows an architecture 1700 of a framework such as the TENSORFLOW framework. As shown, the architecture 1700 includes various features. As an example, in the terminology of the architecture 1700, a client can define a computation as a dataflow graph and, for example, can initiate graph execution using a session. As an example, a distributed master can prune a specific subgraph from the graph, as defined by the arguments to "Session.run( )"; partition the subgraph into multiple pieces that run in different processes and devices; distributes the graph pieces to worker services; and initiate graph piece execution by worker services. As to worker services (e.g., one per task), as an example, they may schedule the execution of graph operations using kernel implementations appropriate to hardware available (CPUs, GPUs, etc.) and, for example, send and receive operation results to and from other worker services. As to kernel implementations, these may, for example, perform computations for individual graph operations.

Figure 18:
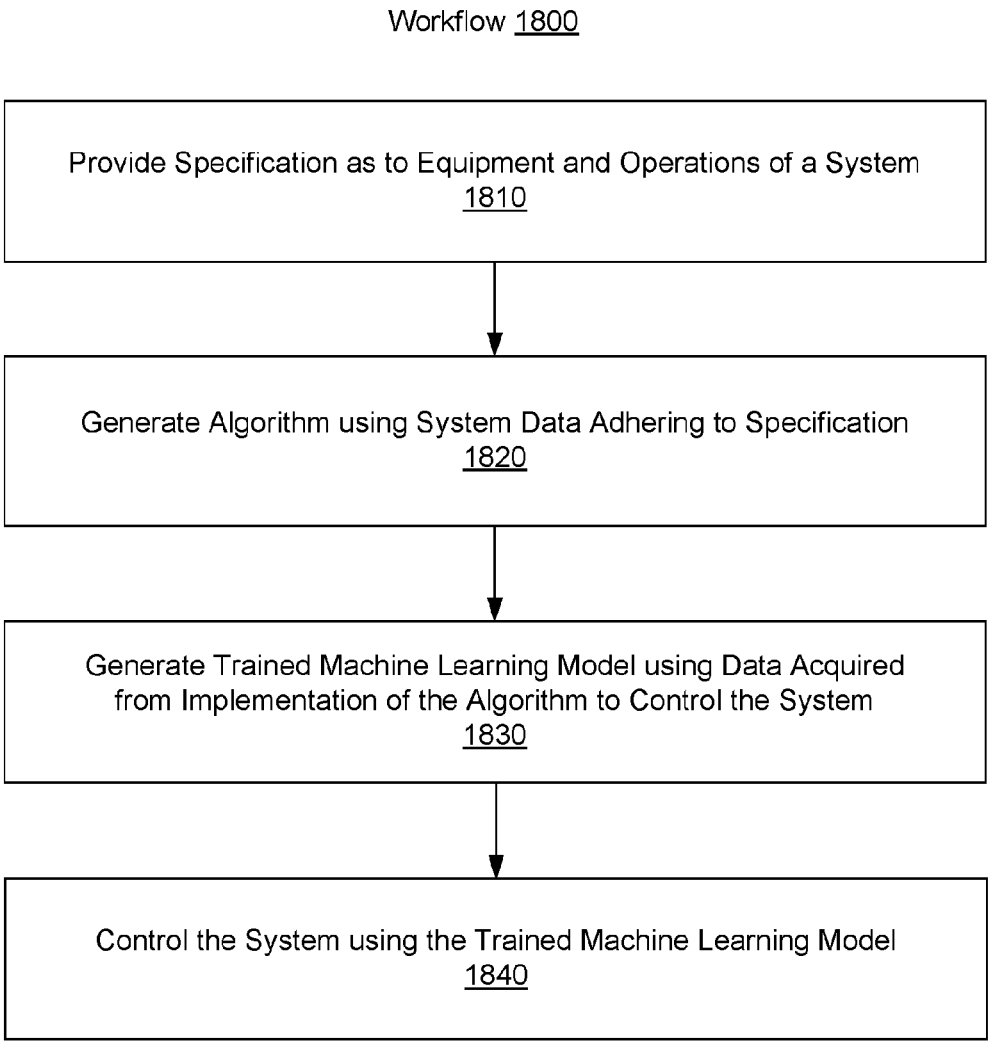
FIG. 18 is a diagram of an example of a method.

FIG. 18 shows an example of a workflow 1800 that includes a provision block 1810 for providing a specification as to equipment and operations of a system, a generation block 1820 for generating an model using system data adhering to the specification (e.g., a decision tree model, etc.), a generation block 1830 for generating a trained machine learning model using data acquired from implementation of the model to control the system; and a control block 1840 for controlling the system using the trained machine learning model.

In the example of FIG. 18, the specification can include sub-system information as to particular sub-systems of the system whereby the sub-systems are amenable to control via parameters where a skilled operator would, in a manual operational mode, set various parameter values in an effort to optimize operation of the sub-system. As an example, where data are sufficient for generation of a machine learning model, the workflow 1800 may proceed to the block 1830, optionally without performing the block 1820 (e.g., without first controlling the system according to the algorithm, etc.). As an example, the machine learning model may be a feedforward neural network that receives data as input and that outputs one or more parameter values in a probabilistic manner. In such an example, the one or more parameter values can be communicated to one or more components of a system for purposes of controlling at least a portion of the system.

As an example, a machine learning process can include acquiring data from one or more systems that can be in fluid communication with one or more wells. In such an example, fluid dynamics responsive to control action may be assessed using machine learning to provide a trained machine learning model that can output tuning parameter values for one or more types of control modes for given input or inputs. In such an example, consider a trained machine learning model that can utilize one or more sensor-based inputs to output one or more tuning parameter values that can provide for suitable control, for example, according to a P, I, D and/or F type of control scheme. As an example, data utilized may be acquired during one or more testing operations where, for example, manually set and/or machine set adjustments are made to one or more pieces of equipment.

As explained, operations can include one or more of surface testing operations, cleanup operations, bleed-off operations, hydraulic fracturing operations, hydraulic fracturing plug drill out (FPDO) operations, hydraulic fracturing flowback operations, production operations, well intervention operations, production facility operations, etc. As explained, fluid dynamics can differ for different types of operations and/or control modes. As an example, a controller can operate in a particular mode that may be associated with a particular set of tuning parameters, which may be selected based on one or more of mode, sensor data, etc.

As an example, a method can include a control block for controlling fluid flow in a system using measurements from a first sensor and a first set of tuning parameter values and a control block for controlling fluid flow in the system using measurements from a second sensor and a second set of tuning parameter values.

Figure 19:
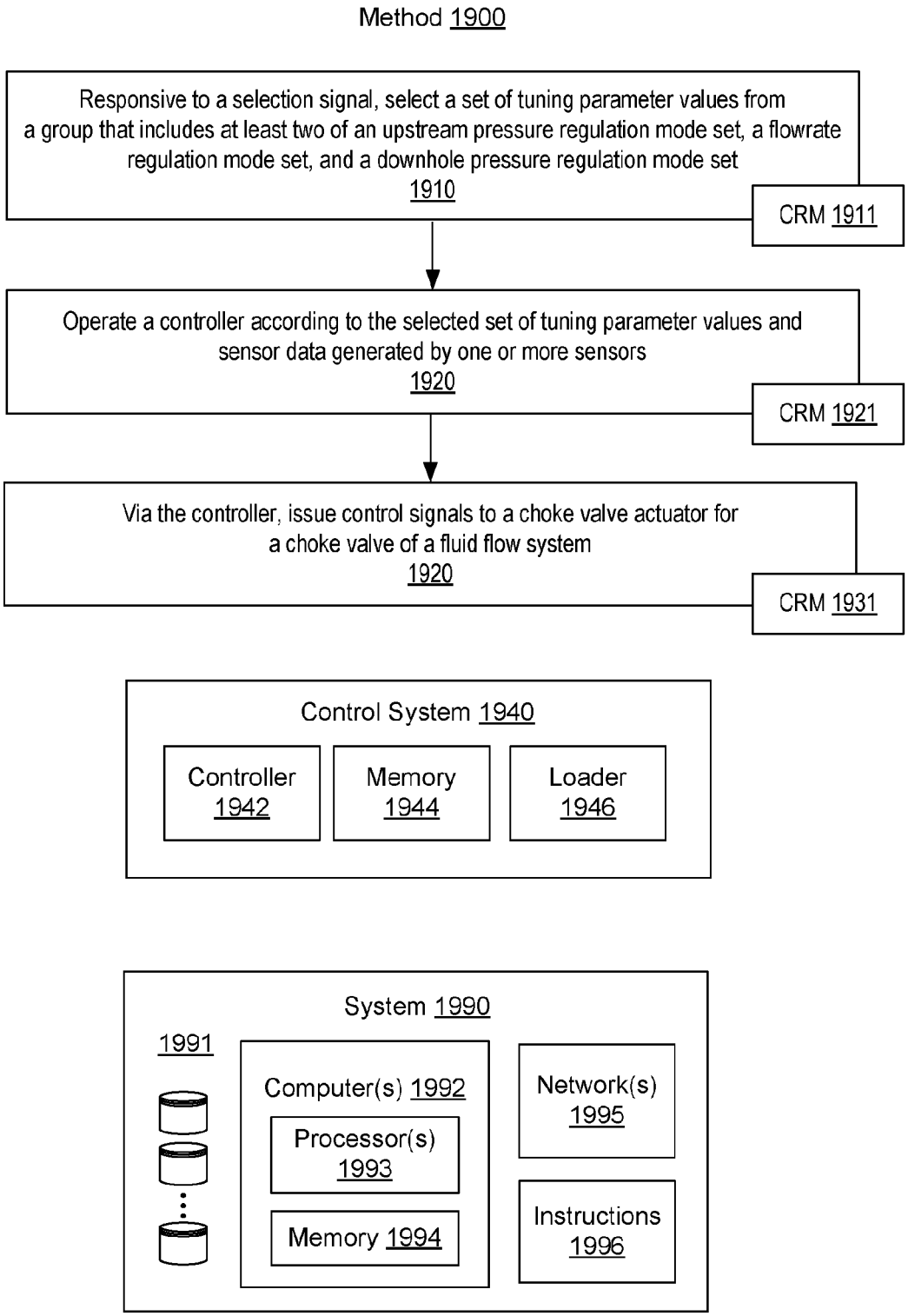
FIG. 19 is a diagram of an example of a method, an example of a control system and an example of a system.

FIG. 19 shows an example of a method 1900, a control system 1940 and a system 1990. As to the method 1900, it can include a selection block 1910 that, responsive to a selection signal, provides for selecting a set of tuning parameter values from a group that includes at least two of an upstream pressure regulation mode set, a flowrate regulation mode set, and a downhole pressure regulation mode set; an operation block 1920 for operating a controller according to the selected set of tuning parameter values and sensor data generated by one or more sensors; and an issuance block 1930 for, via the controller, issuing control signals to a choke valve actuator for a choke valve of a fluid flow system.

The method 1900 is shown as including various computer-readable storage medium (CRM) blocks 1911, 1921 and 1931 that can include processor-executable instructions that can instruct a computing system, which can be a control system, to perform one or more of the actions described with respect to the method 1900.

In FIG. 19, the example control system 1940 can a controller 1942 that includes an interface for receipt of sensor data generated by sensors operatively coupled to a fluid flow system; memory 1944 that includes sets of tuning parameter values; and a loader 1946 that loads a selected set of the sets of tuning parameter values into the controller for issuance of control signals to a choke valve actuator for a choke valve of the fluid flow system according to the selected set of tuning parameter values and sensor data generated by one or more of the sensors. In such an example, the loader 1946 can respond to a selection signal that instructs the loader 1946 to load a selected set of the sets of tuning parameter values and, for example, configures the interface for receipt of sensor data generated by one or more of the sensors. In such an example, a set of tuning parameter values can correspond to a mode where the mode may call for certain data, which may include computed data and/or sensor data. As explained, a control system can be configurable in a mode specific manner for providing two or more different control modes. As an example, one or more features of the control system 1940 can be utilized to perform at least a portion of a method such as at least a portion of the method 1900.

In the example of FIG. 19, the system 1990 includes one or more information storage devices 1991, one or more computers 1992, one or more networks 1995 and instructions 1996. As to the one or more computers 1992, each computer may include one or more processors (e.g., or processing cores) 1993 and memory 1994 for storing the instructions 1996, for example, executable by at least one of the one or more processors 1993 (see, e.g., the blocks 1911, 1921 and 1931). As an example, a computer may include one or more network interfaces (e.g., wired or wireless), one or more graphics cards, a display interface (e.g., wired or wireless), etc.

As an example, the method 1900 may be a workflow that can be implemented using one or more frameworks that may be within a framework environment. As an example, the control system 1940 and/or the system 1990 can include local and/or remote resources. For example, consider a browser application executing on a client device as being a local resource with respect to a user of the browser application and a cloud-based computing device as being a remote resources with respect to the user. In such an example, the user may interact with the client device via the browser application where information is transmitted to the cloud-based computing device (or devices) and where information may be received in response and rendered to a display operatively coupled to the client device (e.g., via services, APIs, etc.).

As an example, a method can include controlling fluid flow in a system using measurements from a first sensor and a first set of tuning parameter values; and controlling fluid flow in the system using measurements from a second sensor and a second set of tuning parameter values. In such an example, the system can include a choke valve where the controlling regulates an opening of the choke valve. In such an example, the first sensor can be upstream from the choke valve, which may be, for example, a downhole sensor. As an example, a second sensor can be downstream from a choke valve.

As an example, a first sensor and a second sensor can include at least one pressure sensor. In such an example, the first sensor and the second sensor can include at least one mass flow sensor. In such an example, a mass flow sensor can be downstream from a choke valve.

As an example, a set of tuning parameters and/or an operational mode may be selected using information as to fluid such as phase information. For example, information from a sensor or sensors may indicate type of fluid or types of fluids and whether multiple phases are present. For example, consider information from a separator, an electric submersible pump (e.g., where gas entrainment may be determined from operational parameters, sensors, etc.), a flow meter, etc.

As an example, a method can include controlling fluid flow in a system using a number of sensors selected from at least three sensors where the selected number of sensors can correspond to a particular set of tuning parameters values. As an example, consider a first sensor, a second sensor and a third sensor and a first set, a second and a third set of tuning parameter values.

As an example, a first set of tuning parameter values can include at least one of a proportional tuning parameter value, an integral tuning parameter value and a derivative tuning parameter value. As an example, a filter parameter value may be provided.

As an example, a second set of tuning parameter values include at least one of a proportional tuning parameter value, an integral tuning parameter value and a derivative tuning parameter value. As an example, a filter parameter value may be provided.

As an example, a first set of tuning parameter values can account for fluid dynamics and a second set of tuning parameter values can account for faster fluid dynamics. In such an example, fluid dynamics may be represented using one or more time constants. For example, consider a time constant that characterizes fluid dynamics for a time between a change to a valve and a time to a substantially steady state.

As an example, a method can include selecting a first set of tuning parameter values from a plurality of sets of tuning parameter values stored in memory. In such an example, the method can include loading the first set of tuning parameter values into a controller that performs the controlling. In such an example, the method can include selecting a second set of tuning parameter values from the plurality of sets of tuning parameter values stored in memory and loading the second set of tuning parameter values into the controller that performs the controlling.

As an example, one or more computer-readable storage media can include computer-executable instructions executable to instruct a controller to: control fluid flow in a system using measurements from a first sensor and a first set of tuning parameter values; and control fluid flow in the system using measurements from a second sensor and a second set of tuning parameter values.

As an example, a control system can include a controller that includes an interface for receipt of sensor data generated by sensors operatively coupled to a fluid flow system; memory that includes sets of tuning parameter values; and a loader that loads a selected set of the sets of tuning parameter values into the controller for issuance of control signals to a choke valve actuator for a choke valve of the fluid flow system according to the selected set of tuning parameter values and sensor data generated by one or more of the sensors. In such an example, the memory can include at least two sets of tuning parameter values. For example, consider a slow dynamics set of tuning parameter values and a fast dynamics set of tuning parameter values. In such an example, the sets can correspond to modes, which may be referred to as control modes, which may correspond to operational modes of a fluid flow system.

As an example, a control system can include an interface that is configurable to receive at least one of pressure sensor data and flow data. In such an example, pressure sensor data may come from one or more pressure sensors. As an example, a controller can include features for computation of mass flow data. For example, consider a processor that can execute instructions of a control system to compute mass flow data. As an example, a control system can include an interface that receives at least one of pressure sensor data and mass flow data and/or the control system can include instructions executable to compute mass flow data.

As an example, a control system can be operatively coupled to sensors where the sensors can include one or more of an upstream pressure sensor disposed between a flow head of a well and the choke valve, a downstream flow sensor disposed downstream from the choke valve, and a downhole pressure sensor.

As an example, sets of tuning parameter values can include a first set for issuance of control signals by a controller to a choke valve actuator using sensor data generated by an upstream pressure sensor disposed between a flow head of a well and the choke valve; a second set for issuance of control signals by the controller to the choke valve actuator using sensor data generated by a downstream flow sensor disposed downstream from the choke valve; and/or a third set for issuance of control signals by the controller to the choke valve actuator using sensor data generated by a downhole pressure sensor.

As an example, a control system can include a loader that selects one of two or more sets of tuning parameter values responsive to a selection signal. In such an example, the selection signal may be generated by a selector. For example, consider an automatic selector or a manual selector (e.g., a selector may include a manual selection feature that can be utilized via a human hand to make a selection such as via touch or use of a human input device (HID)). As an example, a selection signal may correspond to an operational mode of a fluid flow system where, for example, the operational mode is to be controlled using an associated control mode.

As an example, a loader may be part of circuitry that includes a processor and one or more types of memory accessible by the processor where, for example, sets of tuning parameter values may be stored in non-volatile memory and loaded into volatile memory. RAM and cache memory can be types of volatile memory; whereas, non-volatile memory can store information without power being provided thereto (e.g., when power is switched off, etc.). Some examples of non-volatile memory include ROM, HDD, etc. As an example, where a network connection is available, a loader may access one or more set of tuning parameters via the network connection, for example, to load into memory accessible by a controller for purposes of issuing control signals.

As an example, at least one set of a plurality of sets of tuning parameter values can include a proportional tuning parameter value and an integral tuning parameter value. As an example, a set of tuning parameters may include P, I and/or D parameter values and/or one or more other tuning parameter values.

As an example, sets of tuning parameter values may be generated using one or more trained machine learning models. As an example, a trained machine learning model may include weights that are considered a set or sets of tuning parameter values. As explained, a control system may utilize a trained machine learning model or trained machine learning models for issuing control signals to a choke valve actuator for a choke valve.

As an example, a control system can include sets of tuning parameter values that include an upstream pressure regulation mode set that operates according to an upstream pressure set point, where sensor data include sensor data generated by an upstream pressure sensor and a downstream pressure sensor with respect to the choke valve.

As an example, a control system can include sets of tuning parameter values that include a flowrate regulation mode set that operates according to a downstream flow rate set point and that ensures that pressure downstream from the choke valve does not exceed a downstream equipment pressure rating, where feedback can include one or more of a computed flow rate and a sensor-based flow rate.

As an example, a control system can include sets of tuning parameter values that include a downhole pressure regulation mode set that operates according to a downhole pressure value set point, where sensor data include sensor data generated by a downhole pressure sensor.

As an example, a control system can include sets of tuning parameter values that can include two or more of an upstream pressure regulation mode set, a flowrate regulation mode set, and a downhole pressure regulation mode set.

As an example, a method can include, responsive to a selection signal, selecting a set of tuning parameter values from a group that includes at least two of an upstream pressure regulation mode set, a flowrate regulation mode set, and a downhole pressure regulation mode set; operating a controller according to the selected set of tuning parameter values and sensor data generated by one or more sensors; and, via the controller, issuing control signals to a choke valve actuator for a choke valve of a fluid flow system.

As an example, one or more computer-readable media can include processor-executable instructions executable to instruct a control system to: responsive to a selection signal, select a set of tuning parameter values from a group that includes at least two of an upstream pressure regulation mode set, a flowrate regulation mode set, and a downhole pressure regulation mode set; operate according to the selected set of tuning parameter values and sensor data generated by one or more sensors; and issue control signals to a choke valve actuator for a choke valve of a fluid flow system.

As an example, a method can include controlling fluid flow in a choke valve of a well control system using measurements from a sensor and a set of tuning parameter values, where controlling the fluid flow includes adjusting an opening of the choke valve. In such an example, a set of tuning parameter values can be selected from a plurality of sets of tuning parameter values. As an example, a sensor can be upstream of the choke valve or a sensor can be downstream of the choke valve.

As an example, a method can include controlling fluid flow in a system that includes at least one gate valve where controlling includes operating a controller in a mode selected from a plurality of modes. In such an example, the system can include an adjustable manifold assembly that includes at least two gate valves for control of fluid flow fluid from at least two choke valves (see, e.g., the GUI 1600 of FIG. 16, etc.).

As an example, a method can include controlling fluid flow in a system that includes artificial lift equipment and at least one valve, where controlling includes using measurements from a sensor and a set of tuning parameter values. In such an example, the artificial lift equipment can include gas lift equipment, which can include one or more valves, one or more of which may be controllable or not. For example, a downhole valve may be pre-set before being deployed or may be operatively coupled to a controller for control. As an example, artificial lift equipment can include an electric submersible pump (ESP). In such an example, operation of the electric submersible pump can alter downhole pressure. As an example, a sensor can be a sensor of an electric submersible pump assembly. For example, consider a pressure sensor, a temperature sensor, a fluid flow sensor, an electrical wye sensor, etc. As an example, a surface unit that provides and/or controls power supplied to an ESP via a cable may provide various types of information that pertain to control and/or operation of the ESP, which may depend on fluid pressure, fluid composition, phases, solids, etc. As explained, in various instances a system may include one or more separators that aim to separate fluids and/or solids that are produced from a well or wells. As explained, a controller may operate responsive to one or more types of sensor data, which may be indicative of an appropriate mode and/or an appropriate set of tuning parameters, for example, to control one or more valves, etc.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave. As an example, a computer program product can include computer-executable instructions to instruct a computing system to perform one or more methods.

According to an embodiment, one or more computer-readable media may include computer-executable instructions to instruct a computing system to output information for controlling a process. For example, such instructions may provide for output to a sensing process, an injection process, a drilling process, an extraction process, an extrusion process, a pumping process, a heating process, a burning process, an analysis process, etc.

Figure 20:
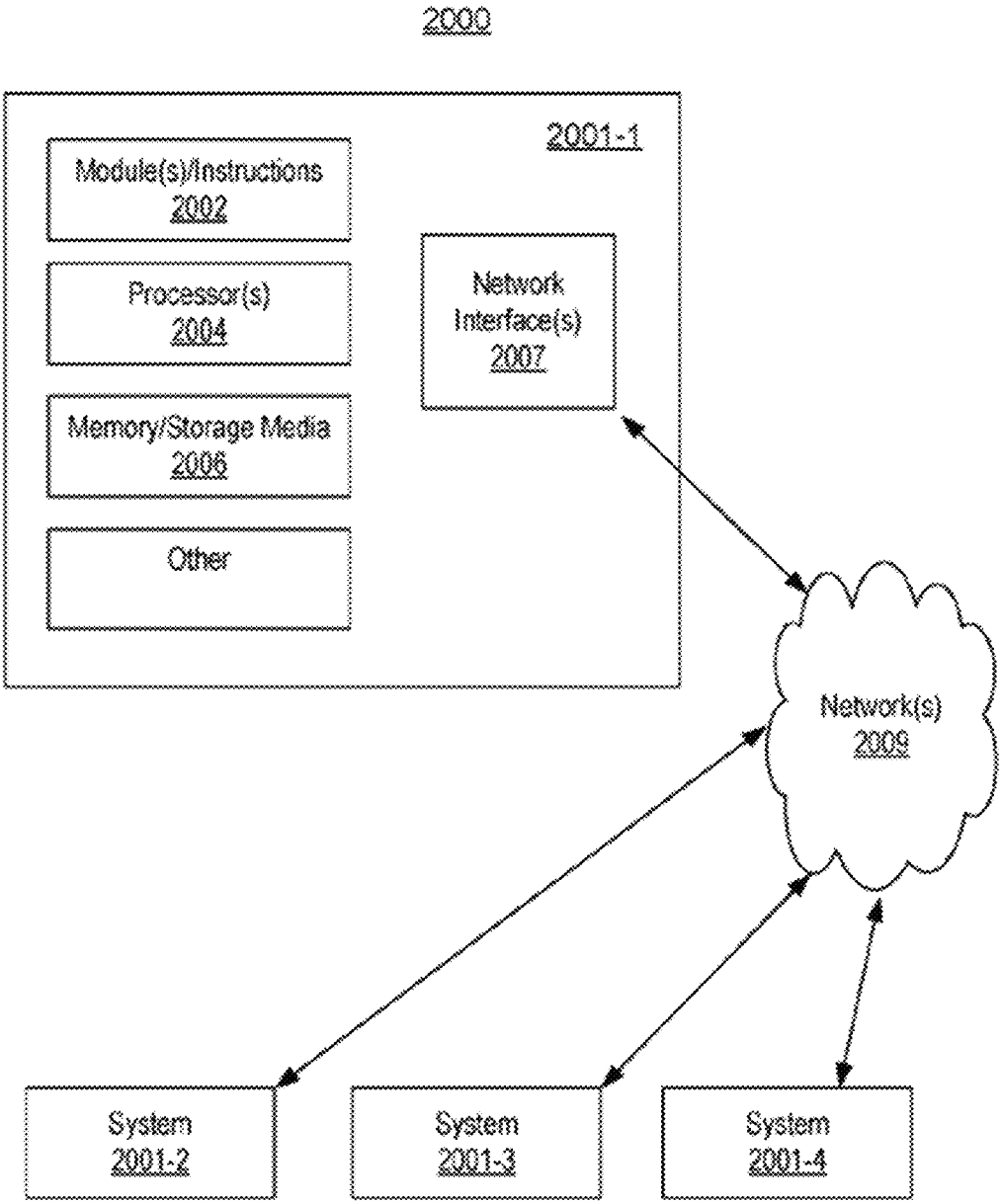
FIG. 20 is a diagram of an example of a computing system.

In some embodiments, a method or methods may be executed by a computing system. FIG. 20 shows an example of a system 2000 that can include one or more computing systems 2001-1, 2001-2, 2001-3 and 2001-4, which may be operatively coupled via one or more networks 2009, which may include wired and/or wireless networks.

As an example, a system can include an individual computer system or an arrangement of distributed computer systems. In the example of FIG. 20, the computer system 2001-1 can include one or more modules 2002, which may be or include processor-executable instructions, for example, executable to perform various tasks (e.g., receiving information, requesting information, processing information, simulation, outputting information, etc.).

As an example, a module may be executed independently, or in coordination with, one or more processors 2004, which is (or are) operatively coupled to one or more storage media 2006 (e.g., via wire, wirelessly, etc.). As an example, one or more of the one or more processors 2004 can be operatively coupled to at least one of one or more network interface 2007. In such an example, the computer system 2001-1 can transmit and/or receive information, for example, via the one or more networks 2009 (e.g., consider one or more of the Internet, a private network, a cellular network, a satellite network, etc.).

As an example, the computer system 2001-1 may receive from and/or transmit information to one or more other devices, which may be or include, for example, one or more of the computer systems 2001-2, etc. A device may be located in a physical location that differs from that of the computer system 2001-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 2006 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 21:
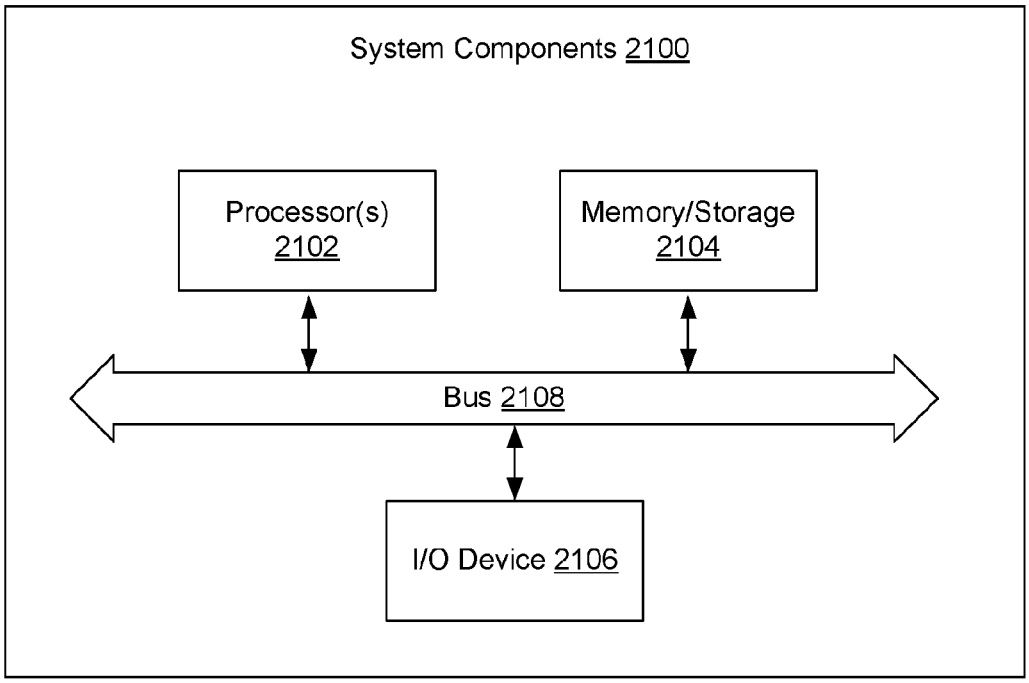
FIG. 21 is a diagram of example components of a system and a networked system.
Figure 21:
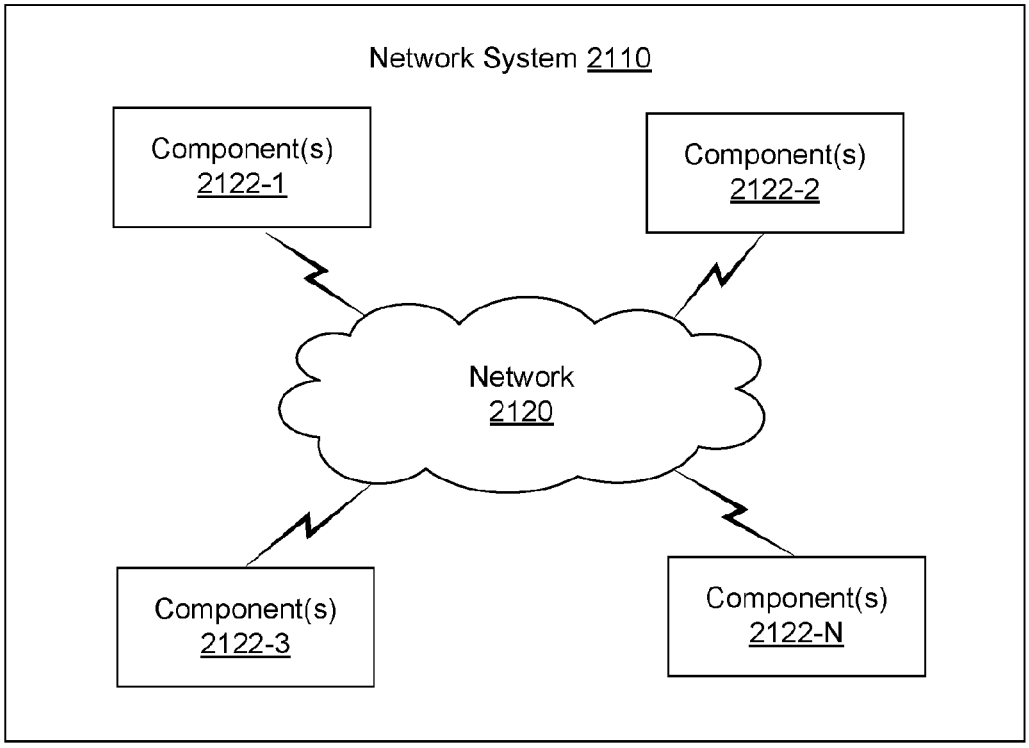

FIG. 21 shows components of a computing system 2100 and a networked system 2110 including a network 2120. The system 2100 includes one or more processors 2102, memory and/or storage components 2104, one or more input and/or output devices 2106 and a bus 2108. According to an embodiment, instructions may be stored in one or more computer-readable media (e.g., memory/storage components 2104). Such instructions may be read by one or more processors (e.g., the processor(s) 2102) via a communication bus (e.g., the bus 2108), which may be wired or wireless. The one or more processors may execute such instructions to implement (wholly or in part) one or more attributes (e.g., as part of a method). A user may view output from and interact with a process via an I/O device (e.g., the device 2106). According to an embodiment, a computer-readable medium may be a storage component such as a physical memory storage device, for example, a chip, a chip on a package, a memory card, etc.

According to an embodiment, components may be distributed, such as in the network system 2110. The network system 2110 includes components 2122-1, 2122-2, 2122-3, . . . 2122-N. For example, the components 2122-1 may include the processor(s) 2102 while the component(s) 2122-3 may include memory accessible by the processor(s) 2102. Further, the component(s) 2122-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A control system comprising:

a controller that comprises an interface for receipt of sensor data generated by sensors operatively coupled to a fluid flow system, the controller configured to receive a selection signal that corresponds to an operating mode of the fluid flow system;

memory that comprises sets of tuning parameter values, wherein the sets of tuning parameter values include (i) a first set of tuning parameter values associated with tuning the controller to issue control signals to a choke valve actuator based on sensor data generated by an upstream pressure sensor disposed between a flow head of a well and a choke valve, the first set of tuning parameter values corresponding to an upstream pressure regulation operating mode and (ii) a second set of tuning parameter values associated with tuning the controller to issue control signals to the choke valve actuator based on sensor data generated by a downstream pressure sensor disposed downstream from the choke valve, the second set of tuning parameter values corresponding to a downstream pressure regulation operating mode; and a loader configured to:

in response to the selection signal indicating a selection of the upstream pressure regulation operating mode:

load the first set of tuning parameter values into the controller for issuance of control signals to the choke valve actuator for the choke valve of the fluid flow system according to the first set of tuning parameter values and sensor data generated by the upstream pressure sensor, and configure the interface to receive sensor data from the upstream pressure sensor; and in response to the selection signal indicating a selection of the downstream pressure regulation operating mode:

load the second set of tuning parameter values into the controller for issuance of control signals to the choke valve actuator for the choke valve of the fluid flow system according to the second set of tuning parameter values and sensor data generated by the downstream pressure sensor, and configure the interface to receive sensor data from the downstream pressure sensor.

2. The control system of claim 1, wherein the memory comprises at least four sets of tuning parameter values.

3. The control system of claim 1, wherein the sets of tuning parameter values comprise a slow dynamics set of tuning parameter values associated with an operating mode in which the controller acquires sensor data on a delayed basis and a fast dynamics set of tuning parameter values associated with an operating mode in which the controller acquires sensor data rapidly.

4. The control system of claim 1, wherein the interface is a serial interface.

5. The control system of claim 1, wherein the controller computes mass flow data.

6. The control system of claim 1, wherein the sets of tuning parameter values comprise a third set of tuning parameter values associated with tuning the controller to issue control signals to the choke valve actuator based on sensor data generated by a downhole pressure sensor, the third set of tuning parameter values corresponding to a downhole pressure regulation operating mode.

7. The control system of claim 6, wherein in response to the selection signal indicating a selection of the downhole pressure regulation operating mode, the loader is further configured to:

load the third set of tuning parameter values into the controller for issuance of control signals according to the third set of tuning parameter values and sensor data generated by the downhole pressure sensor, and configure the interface to receive sensor data from the downhole pressure sensor.

8. The control system of claim 1, wherein the selection signal is generated by a selector.

9. The control system of claim 8, wherein the selector comprises a manual selection feature.

10. The control system of claim 1, wherein the selector is implemented using a graphical user interface.

11. The control system of claim 1, wherein at least one set of the sets of tuning parameter values comprises a proportional tuning parameter value and an integral tuning parameter value.

12. The control system of claim 1, wherein the upstream pressure regulation operating mode operates according to an upstream pressure set point.

13. The control system of claim 1, wherein the sets of tuning parameter values comprise a flowrate regulation mode set that operates according to a downstream flow rate set point and that ensures that pressure downstream from the choke valve does not exceed a downstream equipment pressure rating, and wherein feedback comprises one or more of a computed flow rate and a sensor-based flow rate.

14. The control system of claim 1, wherein the sets of tuning parameter values comprise a downhole pressure regulation mode set that operates according to a downhole pressure value set point, and wherein the sensor data comprise sensor data generated by a downhole pressure sensor.

15. The control system of claim 1, wherein the sets of tuning parameter values comprise a flowrate regulation mode set and a downhole pressure regulation mode set.

16. A method comprising:

responsive to a selection signal that corresponds to an operating mode of a fluid flow system, selecting a set of tuning parameter values from a group that comprises (i) a first set of tuning parameter values associated with regulating pressure upstream from a choke valve based on sensor data generated by an upstream pressure sensor, (ii) a second set of tuning parameter values associated with regulating pressure downstream from the choke valve based on sensor data generated by a downstream pressure sensor, and (iii) a third set of tuning parameter values associated with regulating downhole pressure based on sensor data generated by a downhole pressure gauge;

loading the selected set of tuning parameters into a controller;

configuring an interface of the controller to receive sensor data from a sensor that corresponds to the selected set of tuning parameters; and issuing, by the controller, control signals according to the selected set of tuning parameter values and corresponding sensor data to a choke valve actuator for the choke valve.

17. One or more computer-readable media comprising processor-executable instructions executable to instruct a control system to:

responsive to a selection signal that corresponds to an operating mode of a fluid flow system, select a set of tuning parameter values from a group that comprises (i) a first set of tuning parameter values associated with regulating pressure upstream from a choke valve based on sensor data generated by an upstream pressure sensor, (ii) a second set of tuning parameter values associated with regulating pressure downstream from the choke valve based on sensor data generated by a downstream pressure sensor, and (iii) a third set of tuning parameter values associated with regulating downhole pressure based on sensor data generated by a downhole pressure gauge;

load the selected set of tuning parameters into a controller;

configure an interface of the controller to receive sensor data from a sensor that corresponds to the selected set of tuning parameters; and issue, by the controller, control signals according to the selected set of tuning parameter values and corresponding sensor data to a choke valve actuator for the choke valve.

* * * * *